US009359103B2

(12) United States Patent
Waidelich

(10) Patent No.: US 9,359,103 B2
(45) Date of Patent: Jun. 7, 2016

(54) TWO-PIECE SHIPPING CONTAINER WITH FRANGIBLE OVERLAPPING GLUED RETAINER AREAS

(75) Inventor: John Waidelich, Wauseon, OH (US)

(73) Assignee: Green Bay Packaging, Inc., Green Bay, WI (US)

( * ) Notice: Subject to any disclaimer, the term of this patent is extended or adjusted under 35 U.S.C. 154(b) by 1172 days.

(21) Appl. No.: 13/335,148

(22) Filed: Dec. 22, 2011

(65) Prior Publication Data

US 2012/0160735 A1 Jun. 28, 2012

Related U.S. Application Data

(60) Provisional application No. 61/426,923, filed on Dec. 23, 2010.

(51) Int. Cl.

| | |
|---|---|
| ***B65D 5/52*** | (2006.01) |
| ***B65D 5/32*** | (2006.01) |
| ***B65D 5/54*** | (2006.01) |

(52) U.S. Cl.

CPC ..... *B65D 5/328* (2013.01); *B65D 5/52* (2013.01); *B65D 5/54* (2013.01); *Y10T 29/49815* (2015.01)

(58) Field of Classification Search

CPC ..... B65D 5/52; B65D 5/542; B65D 5/328

USPC ..... 206/736, 738, 772, 774, 773; 229/125.19, 125.32, 125.33, 125.29

See application file for complete search history.

(56) References Cited

U.S. PATENT DOCUMENTS

| | | | | |
|---|---|---|---|---|
| 1,609,186 | A | 11/1926 | Peruzzi | |
| 3,917,158 | A | 11/1975 | Dorofachuk et al. | |
| 4,113,100 | A | 9/1978 | Soja et al. | |
| 4,553,666 | A | 11/1985 | Gullikson | |
| 5,447,225 | A | 9/1995 | Gunn et al. | |
| 5,505,368 | A | 4/1996 | Kanter et al. | |
| 5,507,430 | A * | 4/1996 | Imhoff | 229/125.19 |
| 5,715,993 | A | 2/1998 | Pareike | |
| 5,842,576 | A | 12/1998 | Snow | |
| 6,203,482 | B1 | 3/2001 | Sandford | |
| 6,371,365 | B1 * | 4/2002 | Doucette et al. | 229/120.011 |
| 6,510,982 | B2 | 1/2003 | White et al. | |
| 6,974,033 | B2 | 12/2005 | McLeod et al. | |
| 7,066,379 | B2 | 6/2006 | McLeod et al. | |
| 7,175,066 | B2 | 2/2007 | Varanasi | |

(Continued)

FOREIGN PATENT DOCUMENTS

| | | |
|---|---|---|
| EP | 2014560 | 1/2009 |
| FR | 2713597 | 6/1995 |

*Primary Examiner* — Jacob K Ackun
*Assistant Examiner* — Jenine Pagan
(74) *Attorney, Agent, or Firm* — Boyle Fredrickson, S.C.

(57) ABSTRACT

A shipping and display container and a method of disassembling the same, having a first and second blanks configured to form respective first and second sections of the container when nested. The blanks are affixed to one another at least one cooperating fixation area. When a force is applied, the at least one fixation area of the first section is separated from the first section, and the at least one fixation area of the second section is disengaged from a portion of the second section as to rotate about a hinge. The fixation area of the second section remains affixed to the fixation area of the first section, and allows the first section of the container to be separated from the second section of the container. The second section of the container is retained to display the contents of the container.

12 Claims, 12 Drawing Sheets

(56) References Cited

U.S. PATENT DOCUMENTS

| | | | | |
|---|---|---|---|---|
| 7,410,062 | B2 | 8/2008 | Monk | |
| 7,451,878 | B2 | 11/2008 | Rochefort et al. | |
| 7,478,745 | B2 | 1/2009 | Phillips | |
| 7,628,746 | B2 | 12/2009 | Varanasi | |
| 7,681,727 | B2 | 3/2010 | Hunt et al. | |
| 2005/0263434 | A1* | 12/2005 | Tibbels | 206/767 |
| 2007/0164092 | A1* | 7/2007 | Biundo | 229/117.3 |
| 2007/0221715 | A1* | 9/2007 | Tibbels et al. | 229/125.19 |
| 2010/0043360 | A1 | 2/2010 | DeBusk et al. | |

* cited by examiner 14A
12A
16A
18A
20A
22A
24A
26A
28A
30A
32A
34A
36A
38A
40A
42A
44A
46A
48A
50A
52A
56A
58A
60A
62A
64A
66A
68A
70A
72A
74A
76A
78A
80A
82A
84A
86A
88A
90A
92A
94A
96A
98A 14B
12B
98B
82B
84B
88B
86B
58B
90B
60B
78B
70B
66B
74B
56B
92B
94B
76B
72B
80B
68B
62B
64B
96B
18B
52B
42B
38B
40B
44B
26B
30B
46B
20B
16B
48B
28B
32B
22B
50B
24B

TWO-PIECE SHIPPING CONTAINER WITH FRANGIBLE OVERLAPPING GLUED RETAINER AREAS

CROSS-REFERENCE TO RELATED APPLICATION

This application claims the benefit of U.S. Ser. No. 61/426,923 filed Dec. 23, 2010, the disclosure of which is incorporated herein in its entirety.

FIELD OF THE INVENTION

The present invention relates to a shipping container and, more particularly a two-piece shipping container with overlapping glued retainer areas that can be readily disassembled and selectively converted into a retail display for the products contained within the shipping container.

BACKGROUND OF THE INVENTION

During the shipping and distribution of consumer goods and products, customized packaging is often required. Proper packaging ensures the efficient, economical, and safe delivery of products through various distribution channels. However, once the packaged products arrive at a destination, the packaging must often be disassembled and discarded. For example, in the delivery of foodstuffs to a grocery store, the products must often be removed from packaging and then placed on the store shelves. The process of packaging removal and shelf stocking is often a tedious and time-consuming activity. In the context of large inventory distributors, such as large-scale commercial retailers and big-box stores, a significant amount of time and effort is dedicated to the process of packaging removal and shelf stocking. Additionally, it is not uncommon for the stocking process to require only a few additional products to be placed on a shelf. However, this can be problematic when a large volume shipping package must be disassembled, resulting in left over products without either a package or shelf space in which to store them.

Furthermore, depending on the type of shipping packaging, specialized tools are often required to disassemble a package and remove its contents. Utility knives or wire cutters may often be necessary to cut corrugated containers, heavy gauge plastics, or package banding and straps. The need for such tools may also require additional training and supervision to ensure that the package contents are not damaged during the unpacking process. This need for additional tools, supervision and training further increases the cost of conducting a retail business.

The present invention is intended to solve these and other drawbacks in the prior art. Therefore, it is an object of the present invention to provide a shipping container that can be readily converted into a retail display for the products contained within the shipping container. While the present invention provides a container that is particularly well suited for both shipping and displaying consumer goods and products, it may also be beneficial for other shipping and distribution needs. Furthermore, the present invention may also be used exclusively in the context of shipping products, or in the context of displaying products, but is not limited to the utilization of both functions.

SUMMARY OF THE INVENTION

The present invention provides a shipping and display container, having a first and a second blank configured to form a first and second section of the container, respectively when nested in a first configuration. The blanks are affixed to one another at least one cooperating fixation area. When the blanks are erected in a second configuration to form the first and second sections into a container, a force is applied to the fixation area so that the portion of the first section at the fixation area is separated from the first section, and the at least one fixation area of the second section is disengaged from a portion of the second section as to rotate about a hinge. The fixation area of the second section remains affixed to the fixation area of the first section, and allows the first section of the container to be separated from the second section of the container. The second section of the container is used to display the contained contents.

The present invention further provides a container having a first sheet configured to form a top of the container and a second sheet configured to form a bottom of the container. The first sheet is affixed to the second sheet at least one fixation area, and the top and the bottom of the container are nested together. The at least one fixation area may be in the form of an adhesive secured overlapping area of the first sheet and the second sheet having a partial perforated border. To separate the top and bottom of the container, the partial perforated border is broken so as to disengage the at least one fixation area and enable a user to rotate the fixation area about a hinge defined by the first sheet. This allows the top of the container to be vertically separated from the bottom of the container.

The present invention further provides a method of disassembling a shipping and display container that includes a top section, a bottom section and at least one fixation area at which overlapping portions of the top and bottom sections are secured together. The method includes the steps of inserting a finger into at least one finger access area of the top section of a container; retracting the finger so as to tear a perforation surrounding the fixation area; grasping the top section near the fixation area; lifting the top section vertically off the bottom section; and retaining the contents of the container in the bottom section.

Various other features, objects and advantages of the present invention will be made apparent from the following detailed description of the drawing figures.

BRIEF DESCRIPTION OF THE DRAWINGS

The drawings illustrate a representative embodiment presently contemplated for carrying out the present invention. It should be understood that the invention is not limited to the embodiments disclosed, and is capable of variations within the scope of the appended claims.

In the drawings.

DETAILED DESCRIPTION

I. First Embodiment

Referring initially to FIGS. 1-5, there is shown a container 10A according to one embodiment of the present invention. The container 10A generally is made of a bottom sheet or blank 12A and a top sheet or blank 14A of packaging material. The packaging material may consist of corrugated board, fiberboard, cardboard, or any similar material suitable for use in shipping container construction. The bottom blank 12A and top blank 14A may be stamped or cut from the packaging material, while in a substantially flat orientation, and subsequently folded to form the container 10A. The outer surface of the container 10A may be printed to display information such as content details, shipping information, disassembly instructions, and the like. The outer surface of the container 10A may also contain advertising information, ornamental elements, or apertures to provide ventilation or that allow a portion of the contents to be viewed while in the container 10A.

Figures 1, 2:
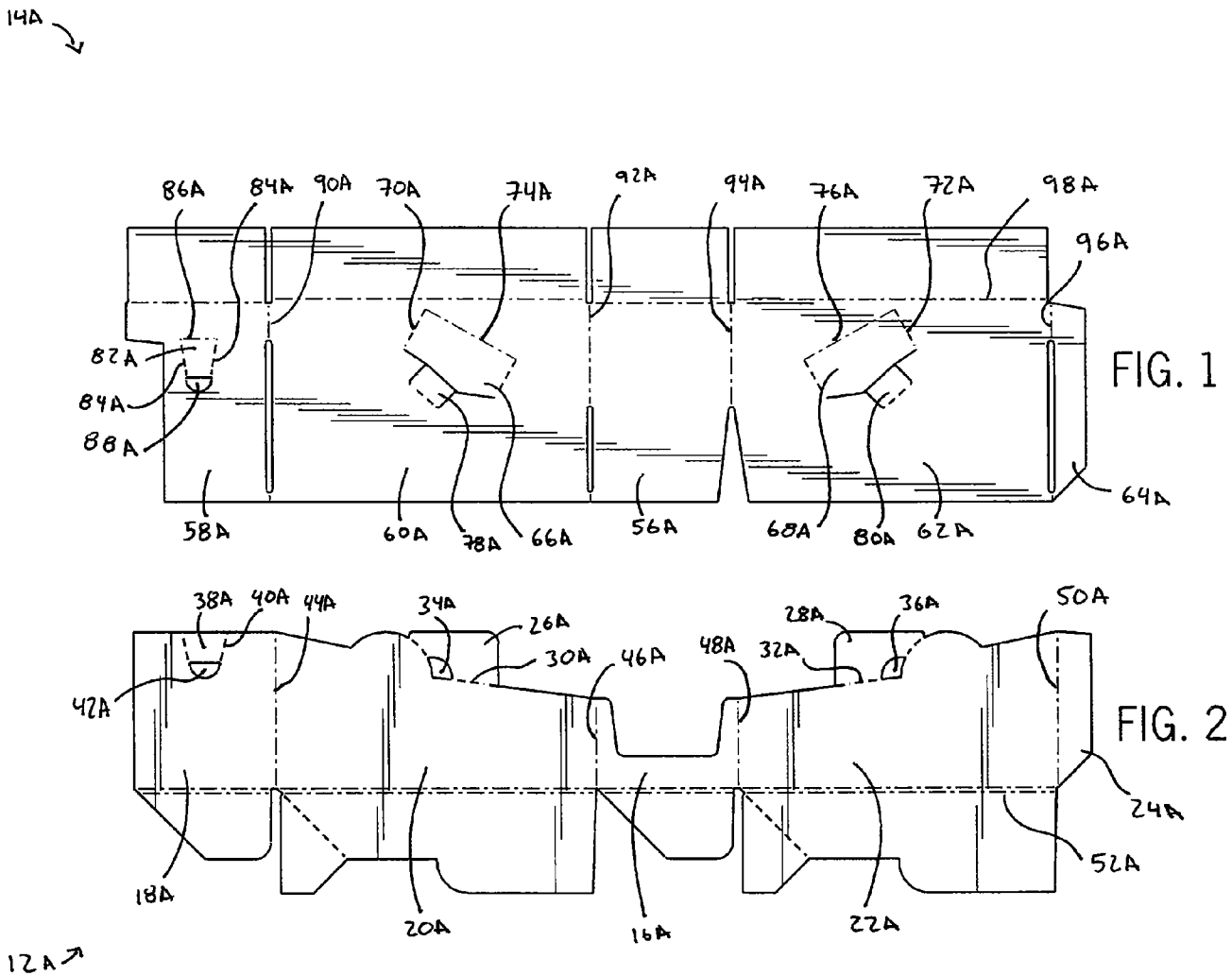
FIG. 1 is a top plan view of an unfolded top blank of a container, according to one aspect of the present invention.
FIG. 2 is a top plan view of an unfolded bottom blank of a container, according to one aspect of the present invention.

FIG. 2 illustrates the bottom blank 12A, formed of a single piece of packaging material in a flat orientation. The bottom blank 12A includes primarily a front panel 16A, a rear panel 18A, and two side panels 20A, 22A. Side panel 22A also includes an extension tab 24A, designed to engage the inner surface of the rear panel 18A when in a folded configuration. Located along the top of the two side panels 20A, 22A are two side tabs 26A, 28A. The side tabs 26A, 28A are formed contiguously with the side panels 20A, 22A, respectively, and may either protrude from the top surface of the side panels 20A, 22A as seen in FIG. 2, or may be integrated into the side panels 20A, 22A. A perforated line 30A, 32A may partition the side tabs 26A, 28A from the side panels 20A, 22A, respectively. Furthermore, the side tabs 26A, 28A may include finger openings 34A, 36A. The finger openings 34A, 36A may consist of a void, as illustrated in FIG. 2, a slot, or simply a perforated area designed to rupture in response to an applied force. Similarly, the rear panel 18A may include a rear tab 38A. The rear tab 38A may either protrude from the top surface of the rear panel 18A or may be integrated into the rear panel 18A. A perforated line 40A may partition the rear tab 38A from rear panel 18A. Also, the rear tab 38A may include a finger opening 42A, designed to allow a user to insert a finger into the container 10A.

The panels 16A, 18A, 20A, and 22A of bottom blank 12A are formed of a single piece of packaging material and divided by vertical score lines 44A, 46A, 48A, and 50A as illustrated in FIG. 2. A bottom score line 52A extends along the bottom of the four panels to differentiate a lower area in each of the four panels. When affixed to the top blank 14A and placed in an erected or folded orientation, the bottom blank 12A is folded along the vertical score lines 44A, 46A, 48A, and 50A until the extension tab 24A engages the inner surface of the rear panel 18A, thereby forming a cuboid open on the opposing top and bottom sides. To maintain the bottom blank 12A in the folded configuration, the extension tab 24A is secured to the inner surface of the rear panel 18A by means of glue, fasteners, adhesive tape or any other known means of fixation. When the lower areas of the four panels 16A, 18A, 20A, and 22A are further folded along the bottom score line 52A, a bottom surface 54A is formed. As seen in FIG. 2, the lower areas of the four panels 16A, 18A, 20A, 22A may be cut in a non linear form such that they interconnect with one another when in a folded configuration, thereby retaining the bottom surface 54A in a closed configuration which may or may not be maintained by glue, fasteners or adhesive tape. Alternatively, the lower areas of the four panels 16A, 18A, 20A, and 22A may be cut in a linear form, and overlap when in a folded configuration that is retained by glue, fasteners or adhesive tape.

Figure 3:
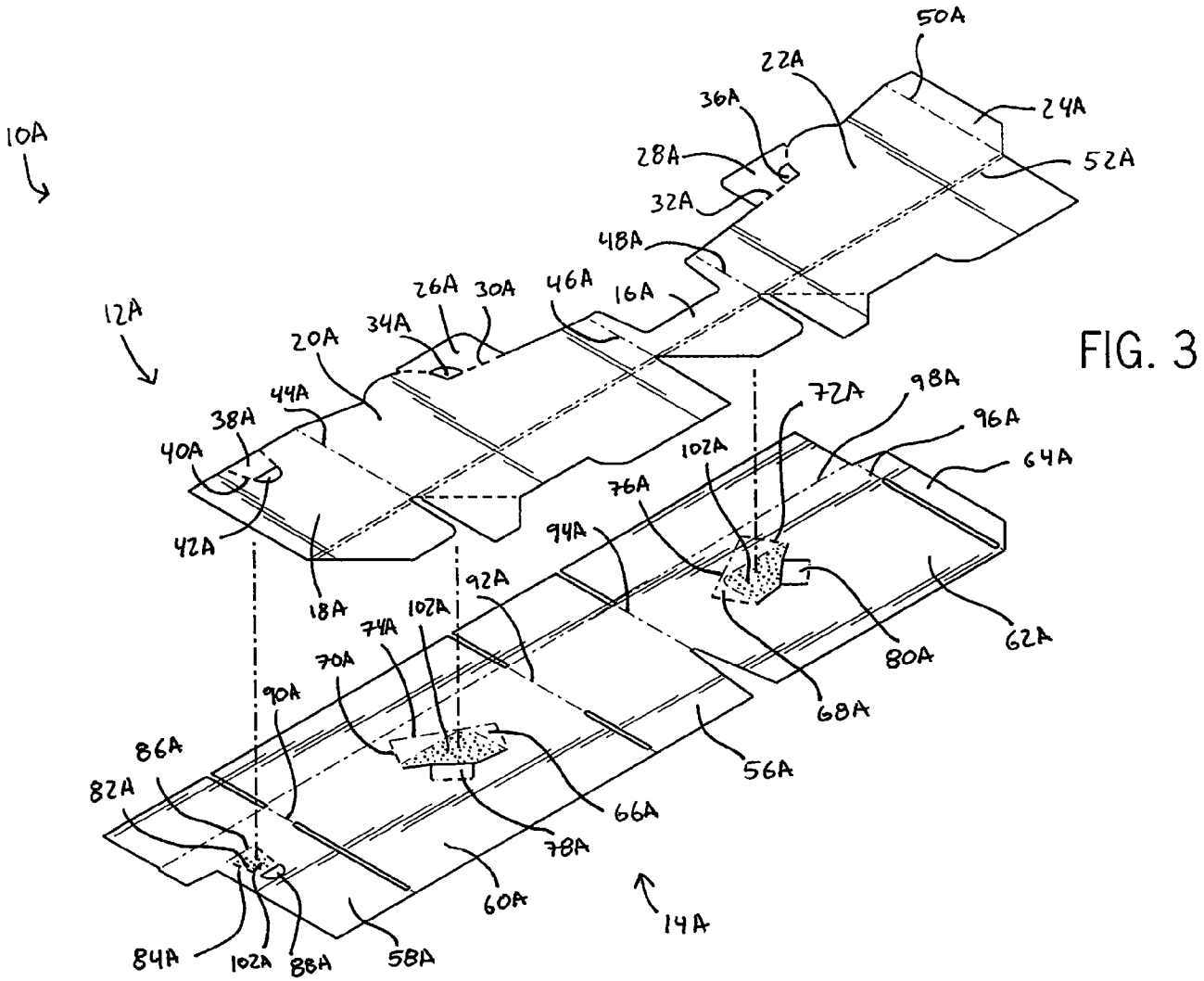
FIG. 3 is an exploded isometric view of the unfolded top blank of FIG. 1 and the unfolded bottom blank of FIG. 2 prior to the unfolded top and bottom blanks being secured together.

FIG. 1 illustrates the top blank 14A, formed of a single piece of packaging material in a flat orientation. The top blank 14A includes primarily a front panel 56A, a rear panel 58A, and two side panels 60A, 62A. Side panel 62A also includes an extension tab 64A, designed to engage both the inner surface of the top sheet rear panel 58A and the inner surface of the bottom sheet rear panel 18A, when in a folded configuration. Located within the side panels 60A, 62A are two side fixation areas 66A, 68A. The side fixation areas 66A, 68A are similar in size to the side tabs 26A, 28A, and are positioned to engage the inner surfaces of the side tabs 26A, 28A when the bottom blank 12A is positioned over the top sheet 14A, as illustrated in FIG. 3. Perforated lines 70A, 72A may partition the side fixation areas 66A, 68A from the two side panels 60A, 62A respectively. In one embodiment, the perforated lines 70A, 72A may include fewer perforations along one edge 74A, 76A of the side fixation areas 66A, 68A, such that the edge 74A, 76A will hinge rather than fully tear when force is applied, as will be discussed in further detail below. Furthermore, the side fixation areas 66A, 68A may include finger openings 78A, 80A located such that they overlap with the bottom sheet finger openings 34A, 36A, as illustrated in FIG. 3. The finger openings 78A, 80A may consist of a void, a slot, or a perforated area designed to rupture in response to an applied force.

In addition, the top sheet rear panel 58A may also include a rear fixation area 82A located within the rear panel 58A. The rear fixation area 82A is similar in size to the rear tab 38A, and is positioned to engage the inner surface of the rear tab 38A when the bottom blank 12A is positioned over the top blank 14A, as illustrated in FIG. 3. A perforated line 84A may partition the rear fixation area 82A from the remainder of the rear panel 58A, and may include fewer perforations along an edge 86A of the rear fixation area 82A, such that the edge 86A will hinge rather than fully tear when force is applied. Additionally, the rear fixation area 82A may include a finger opening 88A located such that it overlaps with the bottom sheet finger opening 42A, as illustrated in FIG. 3. The finger opening 88A may consist of a void, a slot, or a perforated area designed to rupture in response to an applied force.

The panels 56A, 58A, 60A, 62A of top blank 14A are formed of a single piece of packaging material and divided by vertical lines 90A, 92A, 94A, and 96A as illustrated in FIG. 1. The vertical lines 90A, 92A, 94A, and 96A may consist of score lines, apertures, slots or any other style void or structural integrity reduction that facilitates folding of the packaging material. A top score line 98A extends along the top of the four panels to differentiate a top area in each of the four panels. When affixed to the bottom blank 12A and configured in an erected or folded orientation, the top blank 14A is folded along the vertical lines 90A, 92A, 94A, and 96A until the extension tab 64 engages both the inner surface of the top sheet rear panel 58 and the inner surface of the bottom sheet rear panel 18, thereby forming a cuboid open on the opposing top and bottom sides. When the upper areas of the four panels of the top blank 14A are further folded along the top score line 98A, a top surface 100A is formed such that the top blank 14A forms a top section of the container 10A. To maintain the top blank 14A in the folded configuration, the extension tab 64A is secured to the inner surface of the top sheet rear panel 58A by means of glue, fasteners, adhesive tape or any other known means of fixation. As illustrated in FIG. 1, the rear panel 58A may contain extension tabs below the top score line 98A, designed to engage the extension tab 64A in a folded configuration. The top surface 100A may also be retained in its folded configuration by means of glue, fasteners, adhesive tape or any other known means of fixation. Alternatively, the upper areas of the four panels 56A, 58A, 60A, 62A may contain a series of interlocking extensions that retain the top surface 100A in a folded configuration.

Turning now to FIG. 3, the bottom blank 12A and the top blank 14A will be described in an attached configuration. As illustrated in FIG. 3, the bottom blank 12A is oriented over the top blank 14A, such that when in an erected or folded configuration the top section formed by the top blank 12A is nested within the bottom section formed by the bottom blank 12A. The blanks 12A, 14A are aligned such that the bottom blank side tabs 26A, 28A are positioned directly above the top sheet side fixation areas 66A, 68A. In such an orientation, the bottom sheet rear tab 38A is also positioned directly above the top sheet rear fixation area 82A, as illustrated in FIG. 3. As a result, the bottom sheet vertical score lines 44A, 46A, 48A, 50A overlap with the top sheet vertical lines 90A, 92A, 94A, 96A, respectively. To retain the relative location of the bottom blank 12A to the top blank 14A, an adhesive 102A is applied to the interface between the top sheet fixation areas 66A, 68A, 82A and the bottom sheet tabs 26A, 28A, 38A respectively. However, alternative fixation means such as fasteners or adhesive tapes are considered within the scope of this invention.

Figure 5:
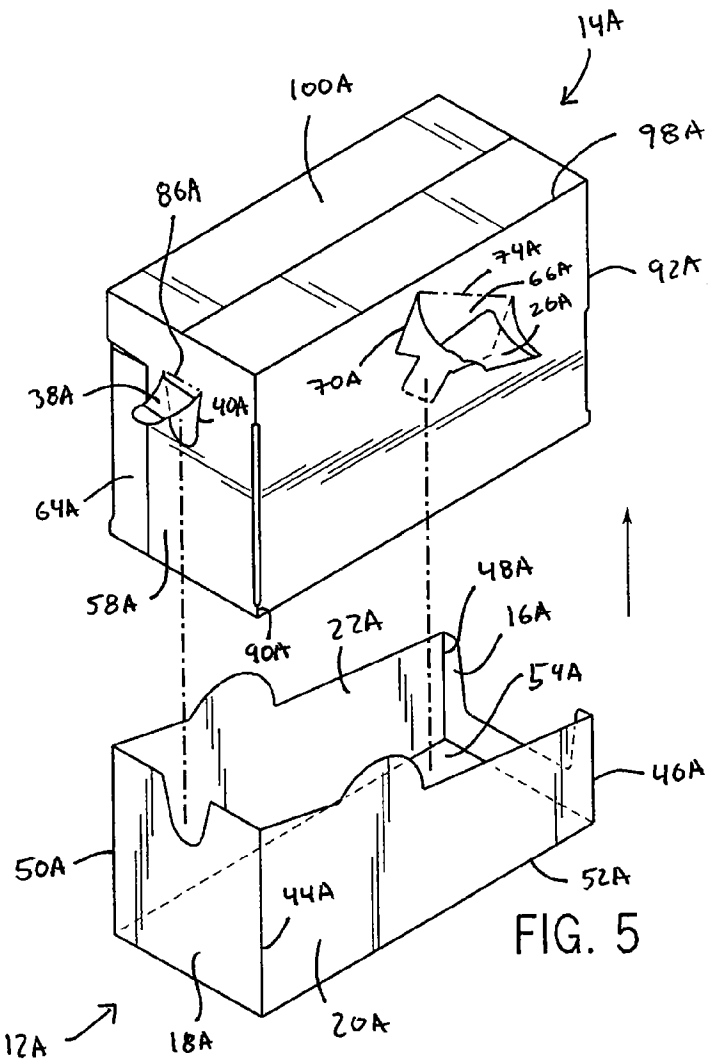
FIG. 5 is a perspective view of the container of FIG. 4, showing the top and bottom sections separated from each other to place the container in an open configuration.
Figure 4:
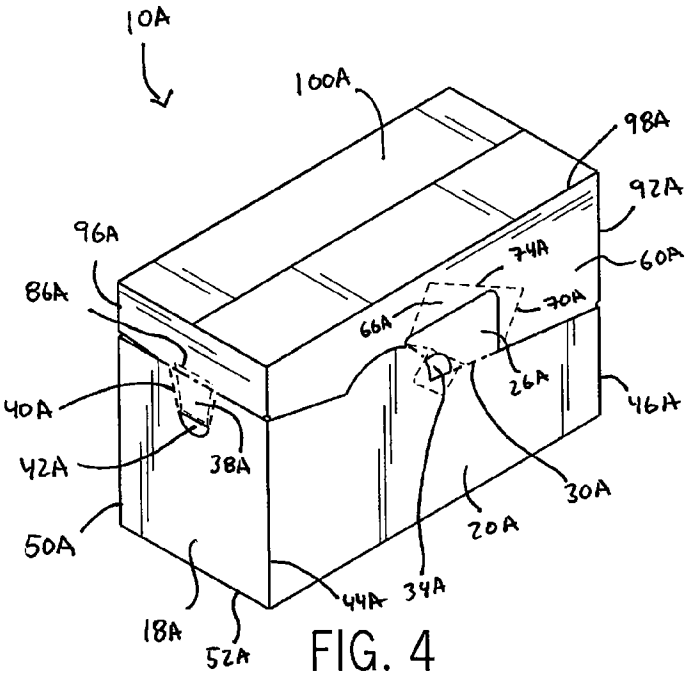
FIG. 4 is a perspective view of a container in accordance with the present invention, which is formed by erecting the secured-together top and bottom blanks as in FIG. 3 to form top and bottom sections, respectively, showing the top and bottom sections together to place the container in a closed configuration.

Having been attached while in a flat configuration, as illustrated in FIG. 3, the bottom blank 12A and the top blank 14A may subsequently be placed in the erected or folded configuration to form container 10A, in order to receive contents therein, as illustrated in FIGS. 4 and 5. The affixed bottom blank 12A and top blank 14A of container 10A are simultaneously folded around the vertical score lines 44A, 46A, 48A, 50A and the vertical lines 90A, 92A, 94A, 96A, respectively until the extension tabs 24A, 64A engage both the inner surface of the top sheet rear panel 58A and the inner surface of the bottom sheet rear panel 18A. Having thereby formed a cuboid open on the opposing top and bottom sides, the extension tab 24A is secured to the inner surface of the bottom sheet rear panel 18A, and the top sheet extension tab 64A is secured to the top sheet rear panel 58A, thereby maintaining the form of the container 10A. Subsequently folding the lower areas of the four panels of the bottom sheet 14A along the bottom score line 52A results in the formation of bottom surface 54A. The bottom surface 54A may either retain its shape by means of frictional engagement of the bottom sheet panels, as illustrated in FIG. 3, or may require the addition of glue, fasteners, adhesive tape or any other known means of fixation. Once the bottom surface 54A of the container 10A is formed, the contents may be loaded into the container 10A via the open top. Representatively, the contents may be oriented such that they face the front panel 16A of the container 10A. After the contents have been loaded in the container 10A, the upper areas of the four panels of the top blank 12A are folded along the top score line 98A, to form top surface 100A. The top surface 100A may be retained in its folded configuration by means of glue, fasteners, adhesive tape or any other known means of fixation. As a result, the contents of the container 10A are fully enclosed within the container 10A, and as such are properly prepared for the shipping or distribution.

After the container 10A has been shipped to its destination, the user will be required to disassemble the container 10A to gain access to the contents contained therein, as illustrated in FIG. 5. To disassemble the container 10A, a user will insert a finger into the finger opening 42A located in the rear panel 18A of the bottom blank 12A and through the finger opening 88A in the rear panel 58A of the top blank 14A. The finger openings 42A, 88A being either a void, a slot, or a perforated area designed to rupture in response to an applied force, will allow the user to extend his or her finger through both blanks 12A, 14A of the container 10A and curl the finger, thereby grasping the inner surface of the rear fixation area 82A. By retracting his or her curled finger, the user exerts a force on the rear fixation area 82A sufficient to tear the perforated line 84A of the top blank 14A as well as the perforated line 40A of the bottom blank 12A. This tearing results in the rear tab 38A disengaging from the bottom blank 12A, while remaining adhesively attached to the top blank 14A rear fixation area 82A, and hinging about the edge 86A.

After the rear tab 38A has been disengaged, the user may repeat a similar process with regard to the side tabs 26A, 28A. Similarly, the user will first insert a finger into the finger opening 34A, 36A located in the side panel 20A, 22A of the bottom blank 12A and through the finger opening 78A, 80A in the side panel 60A, 62A of the top blank 14A. By then curling the finger, the user grasps the inner surface of the side fixation area 66A, 68A. By retracting his or her curled finger, the user exerts a force on the side fixation areas 66A, 68A sufficient to tear the perforated line 70A, 72A of the top blank 14A and the perforated line 30A, 32A of the bottom blank 12A. This tearing results in the side tab 26A, 28A disengaging from the side panel 20A, 22A of the bottom blank 12A, while remaining attached to the top blank 14A side fixation areas 66A, 68A. The side fixation areas 66A, 68A remain adhesively attached to the top blank 14A side fixation areas 66A, 68A, and hinge about the edge 74A, 76A. The user must repeat this process on both sides of the container 10A to fully disengage the top section formed by the top blank 14A from the bottom section formed by the bottom blank 12A, as illustrated in FIG. 5. It should be noted that the rear tab 38A and two side tabs 26A, 28A may be disengaged in any order, prior to lifting top blank 14A off of bottom blank 12A.

Once the rear tab 38A and both side tabs 26A, 28A have been disengaged, the top section of the container formed by top blank 14A is disengaged from the bottom section of the container formed by bottom blank 12A, and the user may remove the top section of the container 10A formed by the top blank 14A, as illustrated in FIG. 5. The user first grasps the top section at the two now protruding fixation areas 66A, 68A. Alternatively, the user may grasp the top section in the openings in the side panels 60A, 62A, which formerly retained the side fixation areas 66A, 68A. By pulling vertically, as illustrated in FIG. 5, the top section formed by top blank 14A lifts and separates from the bottom section formed by bottom blank 12A. As opposed to disassembling traditional shipping containers, this method involves only the tearing of perforated lines, and as such requires no specialized tools for cutting through adhesive tape, packaging material or banding. As the disassembly of container 10A requires no tools, it poses no risk to damaging the product contained therein and therefore eliminates the need for specialized training or supervision during package disassembly.

As a result, after the top section formed by top blank 14A has been removed, the bottom section of the container formed by the bottom blank 12A remains resting, in a folded configuration with the contents of the container 10A contained therein. Accordingly, the bottom section formed by the bottom blank 12A may be used as a tray to display the contents of the container 10A. As illustrated in FIGS. 2 and 5, the front panel 16A of the bottom blank 12A may have a reduced height relative to the other panels 18A, 20A, and 22A; thereby allowing both display of and easy consumer access to the contents of the container 10A. Therefore, the disengaged bottom section formed by bottom blank 12A is particularly well suited for displaying the packages contents in a retail business, or may be placed directly on a store shelf. Placing the bottom section formed by the disengaged bottom blank 12A directly on the store shelf will thereby increase shelf organization, and facilitate more effecting shelf stocking.

II. Second Embodiment

FIGS. 6-10 illustrate a second embodiment of the present invention, shown as container 10B. As described in detail below, container 10B employs side hinging side fixation areas 66B, 68B as may better accommodate minimal height containers.

Figures 6, 7:
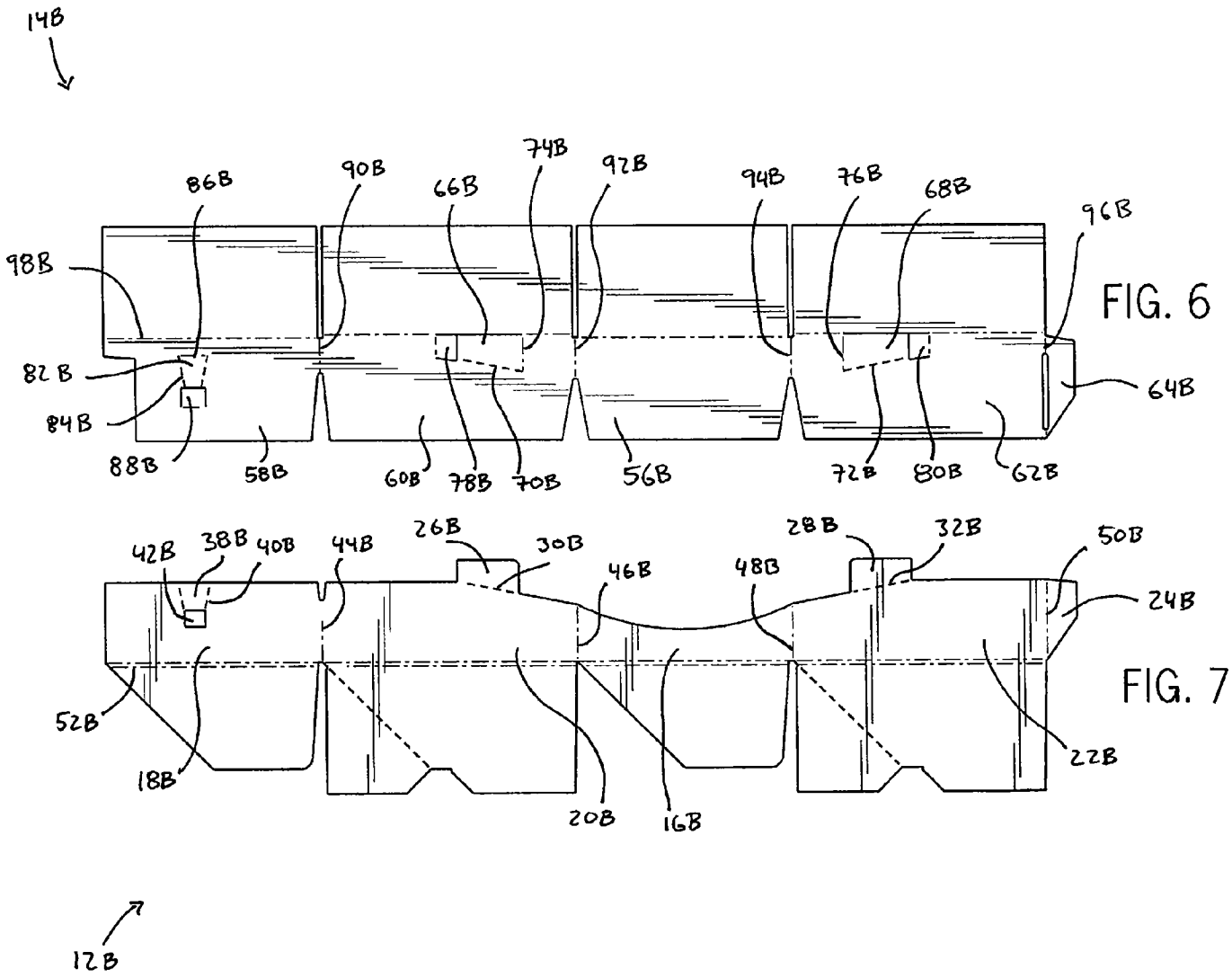
FIG. 6 is a top plan view of an unfolded top blank of a container, according to an a first alternative embodiment of the present invention.
FIG. 7 is a top plan view of an unfolded bottom blank of a container, according to the first alternative embodiment of the present invention.
Figure 8:
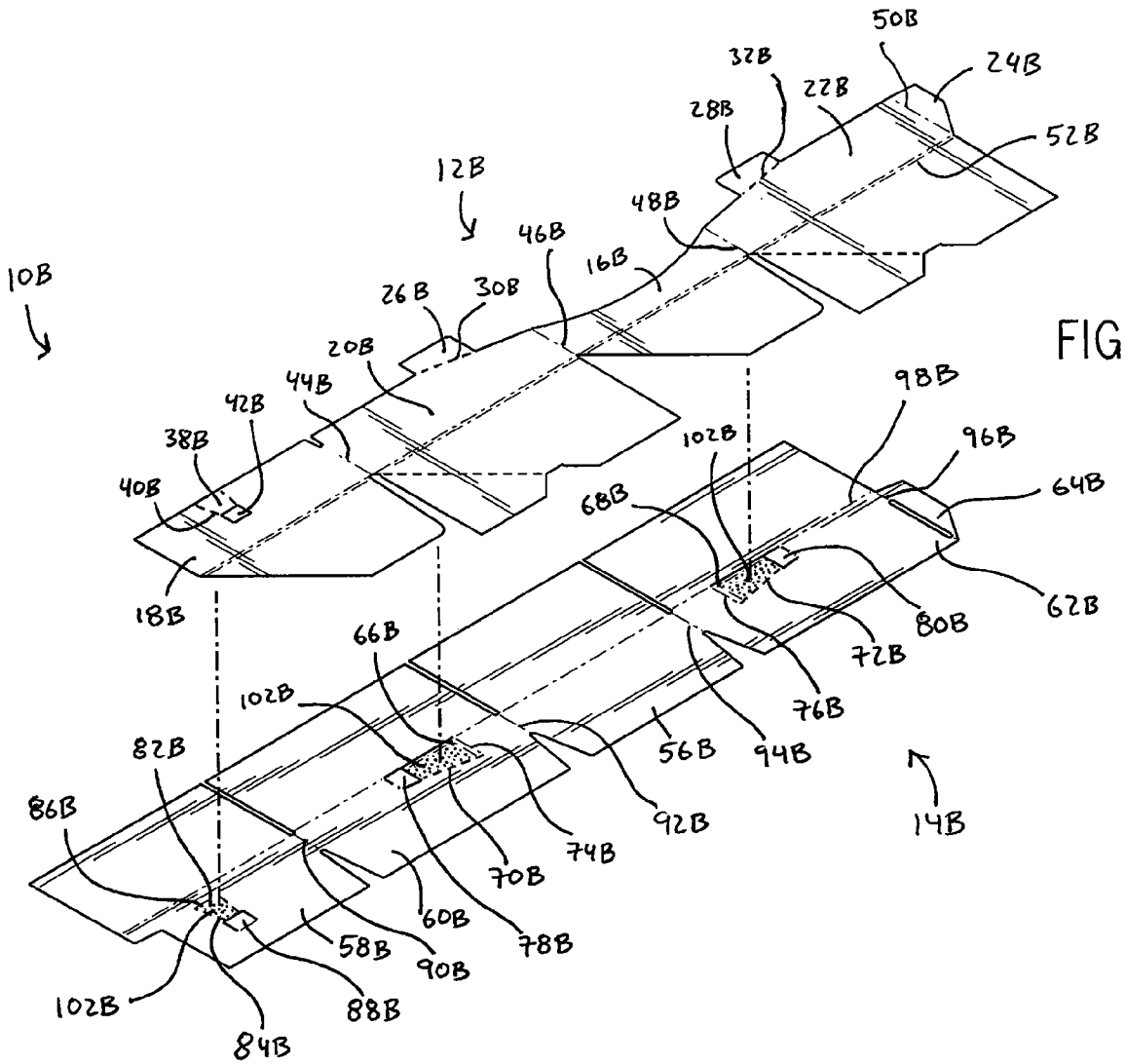
FIG. 8 is an exploded isometric view of the unfolded top blank of FIG. 6 and the unfolded bottom blank of FIG. 5 prior to the unfolded top and bottom blanks being secured together.

Referring initially to FIG. 6-8, the container 10B generally is made of a bottom sheet or blank 12B and a top sheet or blank 14B of packaging material. The packaging material may consist of corrugated board, fiberboard, cardboard, or any similar material suitable for use in shipping container construction. The bottom blank 12B and top blank 14B may be stamped or cut from the packaging material, while in a substantially flat orientation, and subsequently folded to form the container 10B. The outer surface of the container 10B may be printed to display information such as content details, shipping information, disassembly instructions, and the like. The outer surface of the container 10B may also contain advertising information, ornamental elements, or apertures that allow a portion of the contents to be viewed while in the container 10B.

FIG. 7 illustrates the bottom blank 12B, formed of a single piece of packaging material in a flat orientation. The bottom blank 12B includes primarily a front panel 16B, a rear panel 18B, and two side panels 20B, 22B. Side panel 22B also includes an extension tab 24B, designed to engage the inner surface of the rear panel 18B when in a folded configuration. Located along the top of the two side panels 20B, 22B are two side tabs 26B, 28B. The side tabs 26B, 28B are formed contiguously with the side panels 20B, 22B, respectively, and may either protrude from the top surface of the side panels 20B, 22B as illustrated in FIG. 7, or may be integrated into the side panels 20B, 22B. A perforated line 30B, 32B may partition the side tabs 26B, 28B from the side panels 20B, 22B, respectively. While not illustrated in FIG. 7, the side tabs 26B, 28B may include adjacent finger openings, consisting of a void, slot, or simply a perforated area designed to rupture in response to an applied force. Similarly, as seen in FIG. 7, the rear panel 18B may include a rear tab 38B. The rear tab 38B may either protrude from the top surface of the rear panel 18B or may be integrated into the rear panel 18B as illustrated. A perforated line 40B may partition the rear tab 38B from rear panel 18B. Also, the rear tab 38B may include a finger opening 42B, designed to allow a user to insert a finger into the container 10B.

The panels 16B, 18B, 20B, and 22B of bottom blank 12B are formed of a single piece of packaging material and divided by vertical score lines 44B, 46B, 48B, and 50B as illustrated in FIG. 7. A bottom score line 52B extends along the bottom of the four panels to differentiate a lower area in each of the four panels. When affixed to the top blank 14B and placed in an erected or folded orientation, the bottom blank 12B is folded along the vertical score lines 44B, 46B, 48B, and 50B until the extension tab 24B engages the inner surface of the rear panel 18B, thereby forming a cuboid open on the opposing top and bottom sides. To maintain the bottom blank 12B in the folded configuration, the extension tab 24B is secured to the inner surface of the rear panel 18B by means of glue, fasteners, adhesive tape or any other known means of fixation. When the lower areas of the four panels 16B, 18B, 20B, and 22B are further folded along the bottom score line 52B, a bottom surface 54B is formed. As seen in FIG. 7, the lower areas of the four panels 16B, 18B, 20B, 22B may be cut in a non linear form such that they interconnect with one another when in a folded configuration, thereby retaining the bottom surface 54B in a closed configuration which may or may not be maintained by glue, fasteners or adhesive tape. Alternatively, the lower areas of the four panels 16B, 18B, 20B, and 22B may be cut in a linear form, and overlap when in a folded configuration that is retained by glue, fasteners or adhesive tape.

FIG. 6 illustrates the top blank 14B, formed of a single piece of packaging material in a flat orientation. The top blank 14B includes primarily a front panel 56B, a rear panel 58B, and two side panels 60B, 62B. Side panel 62B also includes an extension tab 64B, designed to engage both the inner surface of the top sheet rear panel 58B and the inner surface of the bottom sheet rear panel 18B, when in a folded configuration. Located within the side panels 60B, 62B are two side fixation areas 66B, 68B. The side fixation areas 66B, 68B are similar in size to the side tabs 26B, 28B, and are positioned to engage the inner surfaces of the side tabs 26B, 28B when the bottom blank 12B is positioned over the top sheet 14B, as illustrated in FIG. 8. Perforated lines 70B, 72B may partition the side fixation areas 66B, 68B from the two side panels 60B, 62B respectively. In one embodiment, the perforated lines 70B, 72B may include fewer perforations along an edge 74B, 76B of the side fixation areas 66B, 68B, such that the edge 74B, 76B will hinge rather than fully tear when force is applied. As seen in this embodiment, the edge 74B, 76B is located along a lateral side of the side fixation areas 66B, 68B, such that the side fixation areas 66B, 68B will hinge sideways, as opposed to upwards. Furthermore, the side fixation areas 66B, 68B may include finger openings 78B, 80B located adjacent the side fixation areas 66B, 68B. The finger openings 78B, 80B may consist of a void, a slot, or a perforated area designed to rupture in response to an applied force.

In addition, the top sheet rear panel 58B may also include a rear fixation area 82B located within the rear panel 58B. The rear fixation area 82B is similar in size to the rear tab 38B, and is positioned to engage the inner surface of the rear tab 38B when the bottom blank 12B is positioned over the top blank 14B, as illustrated in FIG. 8. A perforated line 84B may partition the rear fixation area 82B from the remainder of the rear panel 58B, and may include fewer perforations along an edge 86B of the rear fixation area 82B, such that the edge 86B will hinge rather than fully tear when force is applied. Additionally, the rear fixation area 82B may include a finger opening 88B located adjacent the rear fixation area 82B, as illustrated in FIG. 8. The finger opening 88B may consist of a void, a slot, or a perforated area designed to rupture in response to an applied force.

The panels 56B, 58B, 60B, 62B of top blank 14B are formed of a single piece of packaging material and divided by vertical lines 90B, 92B, 94B, and 96B as illustrated in FIG. 6. The vertical lines 90B, 92B, 94B, and 96B may consist of score lines, apertures, slots or any other style void or structural integrity reduction that facilitates folding of the packaging material. A top score line 98B extends along the top of the four panels to differentiate a top area in each of the four panels. When affixed to the bottom blank 12B and configured in an erected or folded orientation, the top blank 14B is folded along the vertical lines 90B, 92B, 94B, and 96B until the extension tab 64B engages both the inner surface of the top sheet rear panel 58B and the inner surface of the bottom sheet rear panel 18B, thereby forming a cuboid open on the opposing top and bottom sides. When the upper areas of the four panels of the top blank 14B are further folded along the top score line 98B, a top surface 100B is formed such that the top blank 14B forms a top section of the container 10B. To maintain the top blank 14B in the folded configuration, the extension tab 64B is secured to the inner surface of the top sheet rear panel 58B by means of glue, fasteners, adhesive tape or any other known means of fixation. As illustrated in FIG. 8, the rear panel 58B may contain extension tabs below the top score line 98B, designed to engage the extension tab 64B in a folded configuration. The top surface 100B may also be retained in its folded configuration by means of glue, fasteners, adhesive tape or any other known means of fixation. Alternatively, the upper areas of the four panels 56B, 58AB, 60B, 62B may contain a series of interlocking extensions that retain the top surface 100B in a folded configuration.

Turning now to FIG. 8, the bottom blank 12B and the top blank 14B will be described in an attached configuration. As illustrated in FIG. 8, the bottom blank 12B is oriented over the top blank 14B, such that when in an erected or folded configuration the top section formed by the top blank 12B is nested within the bottom section formed by the bottom blank 12B. The blanks 12B, 14B are aligned such that the bottom blank side tabs 26B, 28B are positioned directly above the top sheet side fixation areas 66B, 68B. In such an orientation, the bottom sheet rear tab 38B is also positioned directly above the top sheet rear fixation area 82B, as illustrated in FIG. 8. As a result, the bottom sheet vertical score lines 44B, 46B, 48B, 50B overlap with the top sheet vertical lines 90B, 92B, 94B, 96B, respectively. To retain the relative location of the bottom blank 12B to the top blank 14B, an adhesive 102B is applied to the interface between the top sheet fixation areas 66B, 68B, 82B and the bottom sheet tabs 26B, 28B, 38B respectively. However, alternative fixation means such as fasteners or adhesive tapes are considered within the scope of this invention.

Figure 10:
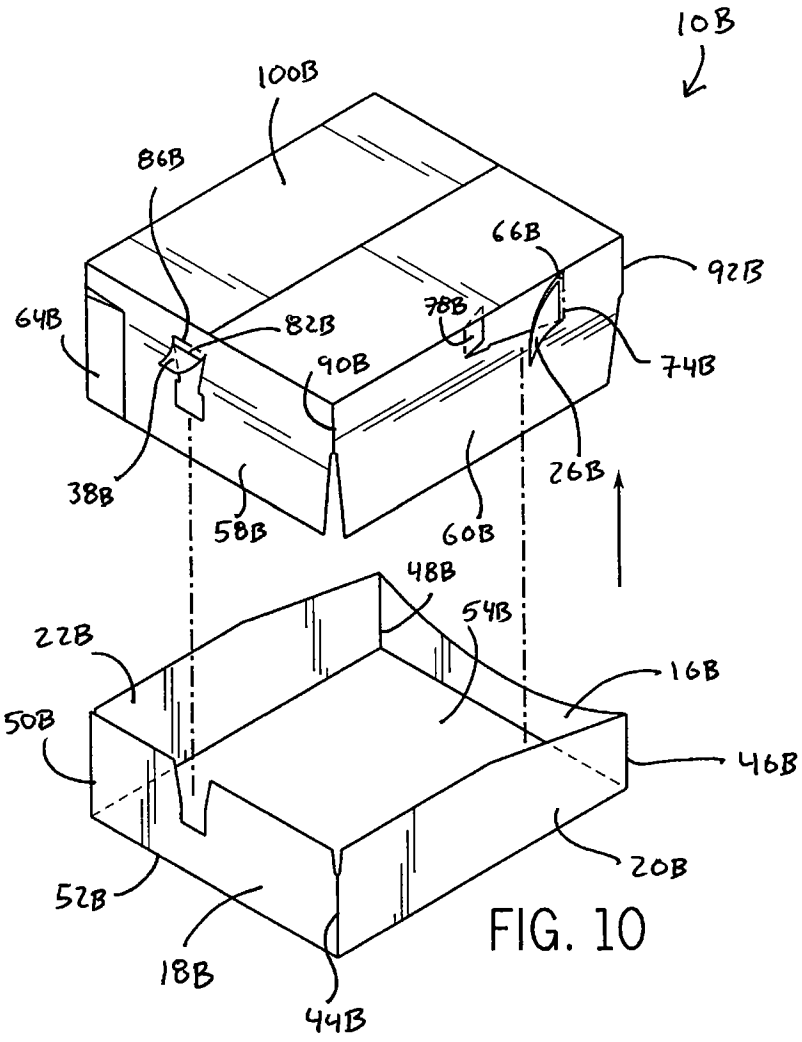
FIG. 10 is a perspective view of the container of FIG. 9, showing the top and bottom sections separated from each other to place the container in an open configuration.
Figure 9:
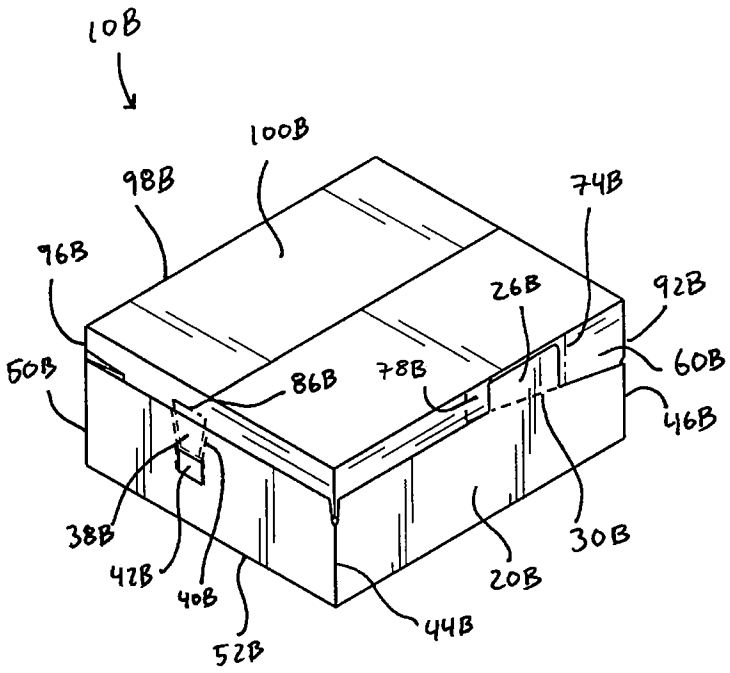
FIG. 9 is a perspective view of a container in accordance with the first alternative embodiment of the present invention, which is formed by erecting the secured-together top and bottom blanks as in FIG. 8 to form top and bottom sections, respectively, showing the top and bottom sections together to place the container in a closed configuration.

Having been attached while in a flat configuration, as illustrated in FIG. 8, the bottom blank 12B and the top blank 14B may subsequently be placed in the erected or folded configuration to form container 10B, in order to receive contents therein, as illustrated in FIGS. 9 and 10. The affixed bottom blank 12B and top blank 14B of container 10B are simultaneously folded around the vertical score lines 44B, 46B, 48B, 50B and the vertical lines 90B, 92B, 94B, 96B, respectively until the extension tabs 24B, 64B engage both the inner surface of the top sheet rear panel 58B and the inner surface of the bottom sheet rear panel 18B. Having thereby formed a cuboid open on the opposing top and bottom sides, the extension tab 24B is secured to the inner surface of the bottom sheet rear panel 18B and the top sheet extension tab 64B is secured to the top sheet rear panel 58B, thereby maintaining the form of the container 10B. Subsequently folding the lower areas of the four panels of the bottom sheet 14B along the bottom score line 52B results in the formation of bottom surface 54B. The bottom surface 54B may either retain its shape by means of frictional engagement of the bottom sheet panels, as illustrated in FIG. 8, or may require the addition of glue, fasteners, adhesive tape or any other known means of fixation. Once the bottom surface 54B of the container 10B is formed, the contents may be loaded into the container 10B via the open top. Representatively, the contents may be oriented such that they face the front panel 16B of the container 10B. After the contents have been loaded in the container 10B, the upper areas of the four panels of the top blank 12B are folded along the top score line 98B, to form top surface 100B. The top surface 100B may be retained in its folded configuration by means of glue, fasteners, adhesive tape or any other known means of fixation. As a result, the contents of the container 10B are fully enclosed within the container 10B, and as such are properly prepared for the shipping or distribution.

After the container 10B has been shipped to its destination, the user will be required to disassemble the container 10B to gain access to the contents contained therein, as illustrated in FIG. 10. To disassemble the container 10B, a user will insert a finger into the finger opening 42B located in the rear panel 18B of the bottom blank 12B and through the finger opening 88B in the rear panel 58B of the top blank 14B. The finger openings 42B, 88B being either a void, a slot, or a perforated area designed to rupture in response to an applied force, will allow the user to extend his or her finger through both blanks 12B, 14B of the container 10B and curl the finger, thereby grasping the inner surface of the rear fixation area 82B. By retracting his or her curled finger, the user exerts a force on the rear fixation area 82B sufficient to tear the perforated line 84B of the top blank 14B as well as the perforated line 40B of the bottom blank 12B. This tearing results in the rear tab 38B disengaging from the bottom blank 12B, while remaining adhesively attached to the top blank 14B rear fixation area 82B, and hinging about the edge 86B.

After the rear tab 38B has been disengaged, the user may repeat a similar process with regard to the side tabs 26B, 28B. Similarly, the user will first insert a finger into the finger opening 78B, 80B in the side panel 60B, 62B of the top blank 14B. By then curling the finger, the user grasps the inner surface of the side fixation area 66B, 68B. By retracting his or her curled finger, the user exerts a force on the side fixation areas 66B, 68B sufficient to tear the perforated line 70B, 72B of the top blank 14B and the perforated line 30B, 32B of the bottom blank 12B. As opposed to the first embodiment, no finger opening are present adjacent the two side tabs 26B, 28B of the bottom blank 12B in this embodiment. This tearing results in the side tab 26B, 28B disengaging from the side panel 20B, 22B of the bottom blank 12B, while remaining attached to the top blank 14B side fixation areas 66B, 68B. The side fixation areas 66B, 68B remain adhesively attached to the top blank 14B side fixation areas 66B, 68B, and hinge about the edge 74B, 76B, which is positioned along the side of the fixation areas 66B, 68B. The user must repeat this process on both sides of the container 10B to fully disengage the top section formed by the top blank 14B from the bottom section formed by the bottom blank 12B, as illustrated in FIG. 10. It should be noted that the rear tab 38B and two side tabs 26B, 28B may be disengaged in any order, prior to lifting top blank 14B off of bottom blank 12B.

Once the rear tab 38B and both side tabs 26B, 28B have been disengaged, the top section of the container formed by top blank 14B is disengaged from the bottom section of the container formed by bottom blank 12B, and the user may remove the top section of the container 10B formed by the top blank 14B, as illustrated in FIG. 10. The user first grasps the top section at the two now protruding fixation areas 66B, 68B, which now function as handles. Alternatively, the user may grasp the top section formed by the top blank 14B in the openings in the side panels 60B, 62B, which formerly retained the side fixation areas 66B, 68B. By pulling vertically, as illustrated in FIG. 10, the top section formed by top blank 14B lifts and separates from the bottom section formed by bottom blank 12B. As opposed to disassembling traditional shipping containers, this method involves only the tearing of perforated lines, and as such requires no specialized tools for cutting through adhesive tape, packaging material or banding. As the disassembly of container 10B requires no stools, it poses no risk to damaging the product contained therein and therefore eliminates the need for specialized training or supervision during package disassembly.

As a result, after the top section formed by the top blank 14B has been removed, the bottom section of the container formed by the bottom blank 12B remains resting, in a folded configuration with the contents of the container 10B contained therein. Accordingly, the bottom section formed by the bottom blank 12B may be used as a tray to display the contents of the container 10B. As illustrated in FIGS. 7 and 10, the front panel 16B of the bottom blank 12B may have a reduced height relative to the other panels 18B, 20B, and 22B; thereby allowing both display of and easy consumer access to the contents of the container 10B. Therefore, the disengaged bottom section formed by the bottom blank 12B is particularly well suited for displaying the packages contents in a retail business, or may be placed directly on a store shelf. Placing the bottom section formed by the disengaged bottom blank 12B directly on the store shelf will thereby increase shelf organization, and facilitate more effecting shelf stocking.

III. Third Embodiment

FIGS. 11-15 illustrate alternative third embodiment of the present invention, shown as container 10C, having an alternative rear panel release structure and method as described in detail below.

Figure 12:
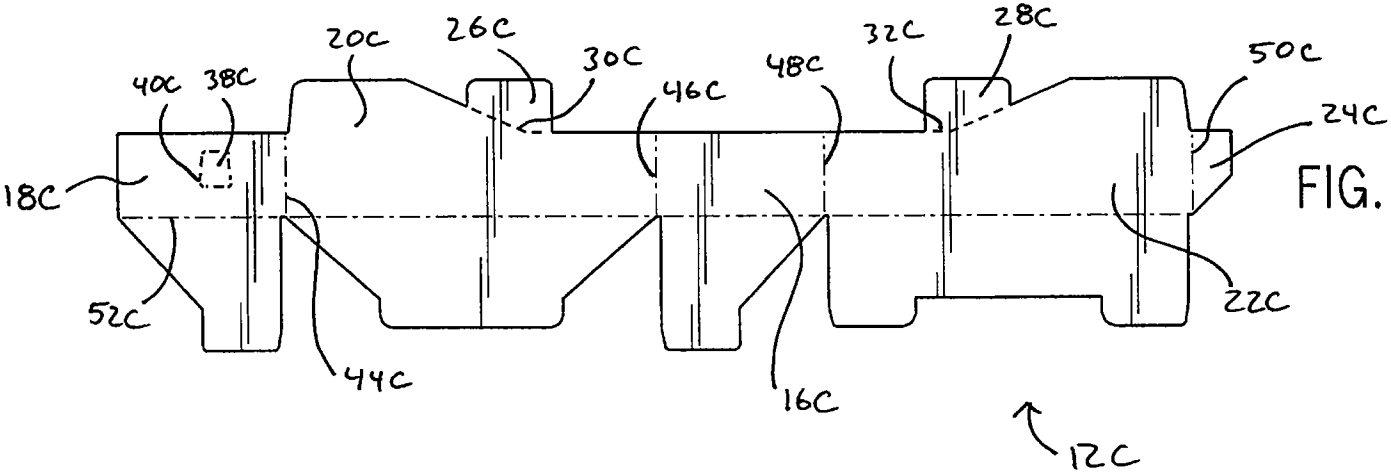
FIG. 12 is a top plan view of an unfolded bottom blank of a container, according to the second alternative embodiment of the present invention.

Referring initially to FIG. 12, the container 10C generally is made of a bottom sheet or blank 12C and a top sheet or blank 14C of packaging material. The packaging material may consist of corrugated board, fiberboard, cardboard, or any similar material suitable for use in shipping container construction. The bottom blank 12C and top blank 14C may be stamped or cut from the packaging material, while in a substantially flat orientation, and subsequently folded to form the container 10C. The outer surface of the container 10C may be printed to display information such as content details, shipping information, disassembly instructions, and the like. The outer surface of the container 10C may also contain advertising information, ornamental elements, or apertures that allow a portion of the contents to be viewed while in the container 10C.

FIG. 12 illustrates the bottom blank 12C, formed of a single piece of packaging material in a flat orientation. The bottom blank 12C includes primarily a front panel 16C, a rear panel 18C, and two side panels 20C, 22C. Side panel 22C also includes an extension tab 24C, designed to engage the inner surface of the rear panel 18C when in a folded configuration. Located along the top of the two side panels 20C, 22C are two side tabs 26C, 28C. The side tabs 26C, 28C are formed contiguously with the side panels 20C, 22C, respectively, and may either protrude from the top surface of the side panels 20C, 22C or may be integrated into the side panels 20C, 22C. A perforated line 30C, 32C may partition the side tabs 26C, 28C from the side panels 20C, 22C, respectively. While not illustrated in FIG. 12, the side tabs 26C, 28C may include adjacent finger openings, consisting of a void, slot, or simply a perforated area designed to rupture in response to an applied force. Similarly, as seen in FIG. 12, the rear panel 18C may include a rear tab 38C. The rear tab 38C may either protrude from the top surface of the rear panel 18C or may be integrated into the rear panel 18C as illustrated in this embodiment. A perforated line 40C may partition the rear tab 38C from rear panel 18C, and may facilitate the rear tab 38C from fully separating from the surrounding rear panel 18C when disengaged, as will be discussed in further detail below. This embodiment, in which the tear tab 38C is intended to be pushed inward to disengage, does not require a finger opening, designed to allow a user to insert a finger into the container 10C as is disclosed in prior embodiments.

The panels 16C, 18C, 20C, and 22C of bottom blank 12C are formed of a single piece of packaging material and divided by vertical score lines 44C, 46C, 48C, and 50C as illustrated in FIG. 12. A bottom score line 52C extends along the bottom of the four panels to differentiate a lower area in each of the four panels. When affixed to the top blank 14C and placed in an erected or folded orientation, the bottom blank 12C is folded along the vertical score lines 44C, 46C, 48C, and 50C until the extension tab 24C engages the inner surface of the rear panel 18C, thereby forming a cuboid open on the opposing top and bottom sides. To maintain the bottom blank 12C in the folded configuration, the extension tab 24C is secured to the inner surface of the rear panel 18C by means of glue, fasteners, adhesive tape or any other known means of fixation. When the lower areas of the four panels 16C, 18C, 20C, and 22C are further folded along the bottom score line 52C, a bottom surface 54C is formed. As seen in FIG. 12, the lower areas of the four panels 16C, 18C, 20C, 22C may be cut in a non linear form such that they interconnect with one another when in a folded configuration, thereby retaining the bottom surface 54C in a closed configuration which may or may not be maintained by glue, fasteners or adhesive tape. Alternatively, the lower areas of the four panels 16C, 18C, 20C, and 22C may be cut in a linear form, and overlap when in a folded configuration that is retained by glue, fasteners or adhesive tape.

Figure 11:
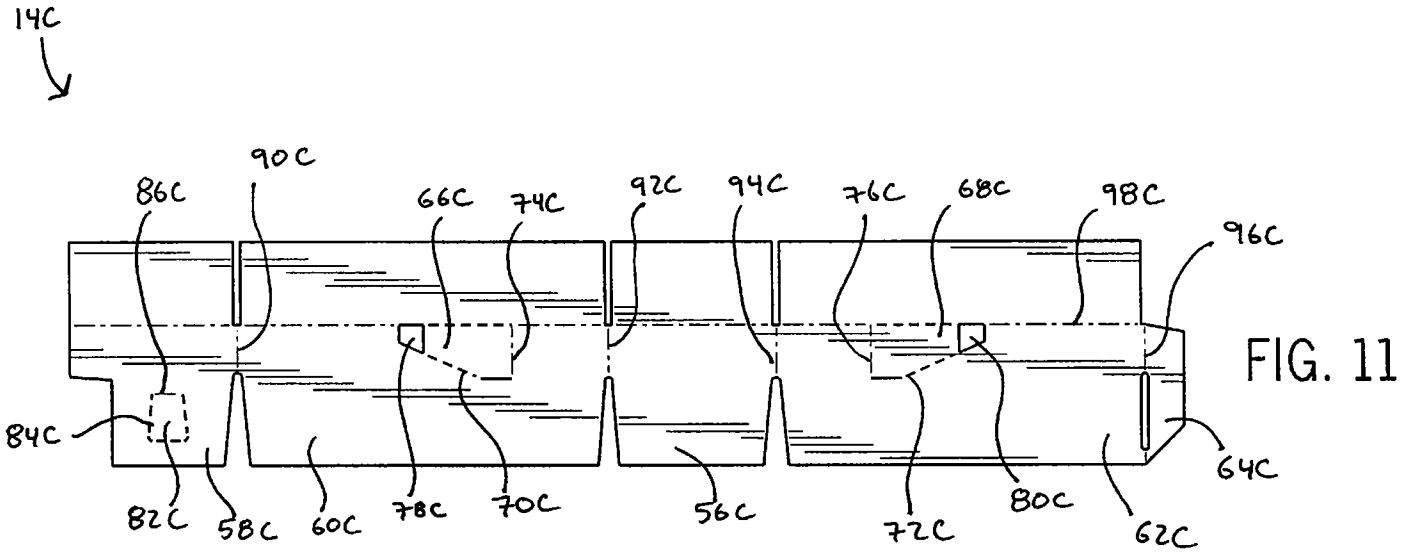
FIG. 11 is a top plan view of an unfolded top blank of a container, according to a second alternative embodiment of the present invention.
Figure 13:
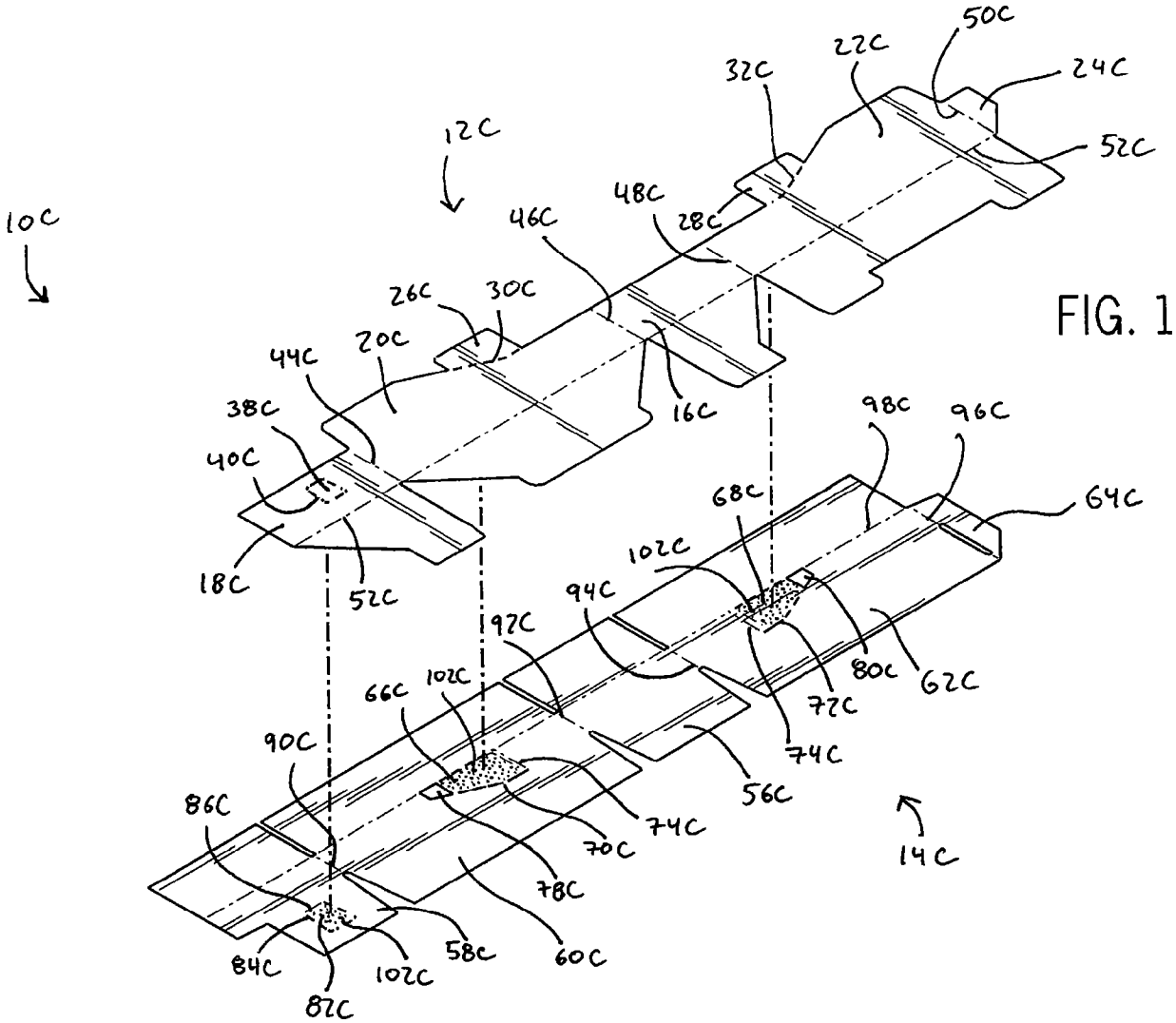
FIG. 13 is an exploded isometric view of the unfolded top blank of FIG. 11 and the unfolded bottom blank of FIG. 12 prior to the unfolded top and bottom blanks being secured together.

FIG. 11 illustrates the top blank 14C, formed of a single piece of packaging material in a flat orientation. The top blank 14C includes primarily a front panel 56C, a rear panel 58C, and two side panels 60C, 62B. Side panel 62C also includes an extension tab 64C, designed to engage both the inner surface of the top sheet rear panel 58C and the inner surface of the bottom sheet rear panel 18C, when in a folded configuration. Located within the side panels 60C, 62C are two side fixation areas 66C, 68C. The side fixation areas 66C, 68C are similar in size to the side tabs 26C, 28C, and are positioned to engage the inner surfaces of the side tabs 26C, 28B when the bottom blank 12C is positioned over the top sheet 14C, as illustrated in FIG. 13. Perforated lines 70C, 72C may partition the side fixation areas 66C, 68C from the two side panels 60C, 62C respectively. In the present embodiment, the perforated lines 70C, 72C may include fewer perforations along one lateral edge 74C, 76C of the side fixation areas 66C, 68C, such that the edge 74C, 76C will hinge rather than fully tear when force is applied, as will be discussed in further detail below. Furthermore, the side fixation areas 66C, 68C may include finger openings 78C, 80C located adjacent the side fixation areas 66C, 68C. The finger openings 78C, 80C may consist of a void, a slot, or a perforated area designed to rupture in response to an applied force.

In addition, the top sheet rear panel 58C may also include a rear fixation area 82C located within the rear panel 58C. The rear fixation area 82C is similar in size to the rear tab 38C, and is positioned to engage the inner surface of the rear tab 38C when the bottom blank 12C is positioned over the top blank 14C, as illustrated in FIG. 13. A perforated line 84C may partition the rear fixation area 82C from the remainder of the rear panel 58C, and may include fewer perforations along an edge 86C of the rear fixation area 82C, such that the edge 86C will hinge rather than fully tear when force is applied. As opposed to alternative embodiments, the rear fixation area 82C does not include a finger opening located adjacent the rear fixation area 82C, as the rear fixation area 82C is designed to be disengaged by means of pushing inward as opposed to being pulled outward.

The panels 56C, 58C, 60C, 62C of top blank 14C are formed of a single piece of packaging material and divided by vertical lines 90C, 92C, 94C, and 96C as illustrated in FIG. 11. The vertical lines 90C, 92C, 94C, and 96C may consist of score lines, apertures, slots or any other style void or structural integrity reduction that facilitates folding of the packaging material. A top score line 98C extends along the top of the four panels to differentiate a top area in each of the four panels. When affixed to the bottom blank 12C and configured in an erected or folded orientation, the top blank 14C is folded along the vertical lines 90C, 92C, 94C, and 96C until the extension tab 64C engages both the inner surface of the top sheet rear panel 58C and the inner surface of the bottom sheet rear panel 18C, thereby forming a cuboid open on the opposing top and bottom sides. When the upper areas of the four panels of the top blank 14C are further folded along the top score line 98C, a top surface 100C is formed such that the top blank 14C forms a top section of the container 10C. To maintain the top blank 14C in the folded configuration, the extension tab 64C is secured to the inner surface of the top sheet rear panel 58C by means of glue, fasteners, adhesive tape or any other known means of fixation. As illustrated in FIG. 13, the rear panel 58C may contain extension tabs below the top score line 98C, designed to engage the extension tab 64C in a folded configuration. The top surface 100C may also be retained in its folded configuration by means of glue, fasteners, adhesive tape or any other known means of fixation. Alternatively, the upper areas of the four panels 56C, 58C, 60C, 62C may contain a series of interlocking extensions that retain the top surface 100C in a folded configuration.

Turning now to FIG. 13, the bottom blank 12C and the top blank 14C will be described in an attached configuration. As illustrated in FIG. 13, the bottom blank 12C is oriented over the top blank 14C, such that when in an erected or folded configuration the top section formed by the top blank 12C is nested within the bottom section formed by the bottom blank 12C. The blanks 12C, 14C are aligned such that the bottom blank side tabs 26C, 28C are positioned directly above the top sheet side fixation areas 66C, 68C. In such an orientation, the bottom sheet rear tab 38C is also positioned directly above the top sheet rear fixation area 82C, as illustrated in FIG. 13. As a result, the bottom sheet vertical score lines 44C, 46C, 48C, 50C overlap with the top sheet vertical lines 90C, 92C, 94C, 96C, respectively. To retain the relative location of the bottom blank 12C to the top blank 14C, an adhesive 102C is applied to the interface between the top sheet fixation areas 66C, 68C, 82C and the bottom sheet tabs 26BC, 28C, 38C respectively. However, alternative fixation means such as fasteners or adhesive tapes are considered within the scope of this invention.

Figure 15:
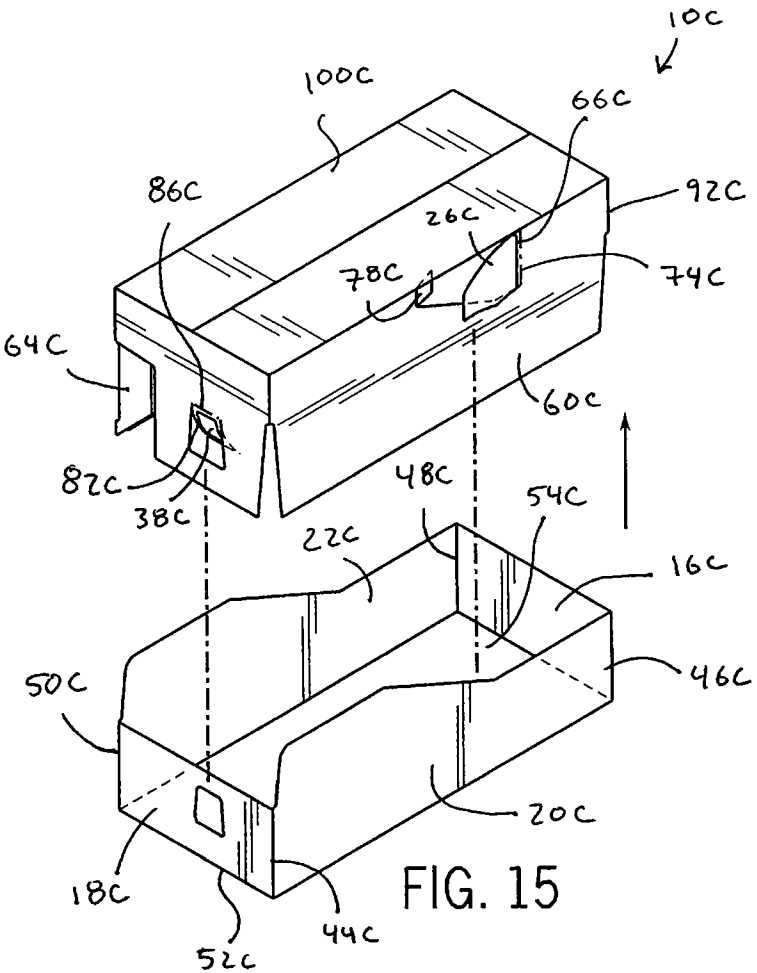
FIG. 15 is a perspective view of the container of FIG. 14, showing the top and bottom sections separated from each other to place the container in an open configuration.
Figure 14:
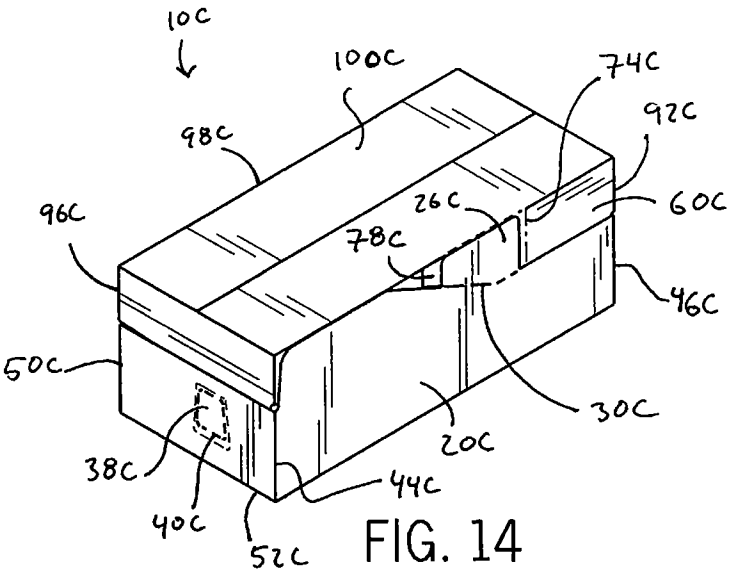
FIG. 14 is a perspective view of the container in accordance with the second alternative embodiment of the present invention, which is formed by erecting the secured-together top and bottom blanks as in FIG. 13 to form top and bottom sections, respectively, showing the top and bottom sections together to place the container in a folded and closed configuration.

Having been attached while in a flat configuration, as illustrated in FIG. 13, the bottom blank 12C and the top blank 14C may subsequently be placed in the erected or folded configuration to form container 10C, in order to receive contents therein, as illustrated in FIGS. 14 and 15. The affixed bottom blank 12C and top blank 14C of container 10C are simultaneously folded around the vertical score lines 44C, 46C, 48C, 50C and the vertical lines 90C, 92C, 94C, 96C, respectively until the extension tabs 24C, 64C engage both the inner surface of the top sheet rear panel 58C and the inner surface of the bottom sheet rear panel 18C. Having thereby formed a cuboid open on the opposing top and bottom sides, the extension tab 24C is secured to the inner surface of the bottom sheet rear panel 18C and the top sheet extension tab 64C is secured to the top sheet rear panel 58C, thereby maintaining the form of the container 10C. Subsequently folding the lower areas of the four panels of the bottom sheet 14C along the bottom score line 52C results in the formation of bottom surface 54C. The bottom surface 54C may either retain its shape by means of frictional engagement of the bottom sheet panels, or may require the addition of glue, fasteners, adhesive tape or any other known means of fixation. Once the bottom surface 54C of the container 10C is formed, the contents may be loaded into the container 10C via the open top. Representatively, the contents may be oriented such that they face the front panel 16C of the container 10C. After the contents have been loaded in the container 10C, the upper areas of the four panels of the top blank 12C are folded along the top score line 98C, to form top surface 100C. The top surface 100C may be retained in its folded configuration by means of glue, fasteners, adhesive tape or any other known means of fixation. As a result, the contents of the container 10C are fully enclosed within the container 10C, and as such are properly prepared for the shipping or distribution.

After the container 10C has been shipped to its destination, the user will be required to disassemble the container 10C to gain access to the contents contained therein, as illustrated in FIG. 15. To disassemble the container 10C, a user will push a finger into, i.e. exert a linear force onto rear tab 38C of the bottom blank rear panel 18C. This force will simultaneously be transferred to the rear fixation area 82C of the rear panel 58C. When sufficient force has been exerted by the user, the perforated line 40C, which entirely surrounds the rear tab 38C will tear, as will the perforated line 84C, which surrounds three sides of the rear fixation area 82C. This tearing results in the rear tab 38C disengaging from the bottom blank 12C, while remaining adhesively attached to the top blank 14C rear fixation area 82C, and both the rear tab 38C and rear fixation are 82C hinging to the top blank 14C about the edge 86C. Hinging about edge 86C will maintain the rear tab 38C in a hinged orientation, while protruding slightly into the interior of the container 10C, thereby not interfering with the vertical separation of the top and bottom sections of the container 10B.

After the rear tab 38C has been disengaged, the user may disengage the side tabs 26C, 28C. Unlike the rear tab 28C which is disengaged by pushing inwards, the side tabs 26C, 28C will be disengaged by pulling outward. Accordingly, the user will first insert a finger into the finger opening 78C, 80C in the side panel 60C, 62C of the top blank 14C. By then curling the finger, the user grasps the inner surface of the side fixation area 66C, 68C. By retracting his or her curled finger, the user exerts a force on the side fixation areas 66C, 68C sufficient to tear the perforated line 70C, 72C of the top blank 14C and the perforated line 30C, 32C of the bottom blank 12C. As opposed to the first embodiment, no finger openings are present adjacent the two side tabs 26C, 28C of the bottom blank 12C in this embodiment. This tearing results in the side tab 26C, 28C disengaging from the side panel 20C, 22C of the bottom blank 12C, while remaining attached to the side fixation areas 66C, 68C of the top blank 14C. The side fixation areas 66C, 68C remain adhesively attached to the side fixation areas 66C, 68C of the top blank 14C, and hinge about the edge 74C, 76C, which is positioned along the side of the fixation areas 66C, 68C. The user must repeat this process on both sides of the container 10C to fully disengage the top section formed by the top blank 14C from the bottom section formed by the bottom blank 12C, as illustrated in FIG. 15. It should be noted that the rear tab 38C and two side tabs 26C, 28C may be disengaged in any order, prior to lifting the top section formed by the top blank 14C off of the bottom section formed by the bottom blank 12C.

Once the rear tab 38C and both side tabs 26C, 28C have been disengaged, the top section of the container formed by the top blank 14C is disengaged from the bottom section of the container formed by bottom blank 12C, and the user may remove the top section of the container 10C formed by the top blank 14C, as illustrated in FIG. 15. The user first grasps the top section formed by the top blank 14C at the two now protruding fixation areas 66C, 68C, which function as handles. Alternatively, the user may grasp the top section formed by the top blank 14C in the openings in the side panels 60C, 62C, which formerly retained the side fixation areas 66C, 68C. By pulling vertically, as illustrated in FIG. 15, the top section formed by the top blank 14C lifts and separates from the bottom section formed by the bottom blank 12C. As opposed to disassembling traditional shipping containers, this method involves only the tearing of perforated lines, and as such requires no specialized tools for cutting through adhesive tape, packaging material or banding. As the disassembly of container 10C requires no tools, it poses no risk to damaging the product contained therein and therefore eliminates the need for specialized training or supervision during package disassembly.

As a result, after the top section formed by the top blank 14C has been removed, the bottom section of the container formed by the bottom blank 12C remains resting, in a folded configuration with the contents of the container 10C contained therein. Accordingly, the bottom section formed by the bottom blank 12C may be used as a tray to display the contents of the container 10C. As illustrated in FIGS. 12 and 15, the front panel 16C of the bottom blank 12C may have a reduced height relative to the other panels 18C, 20C, and 22C; thereby allowing both display of and easy consumer access to the contents of the container 10C. Therefore, the disengaged section formed by the bottom blank 12C is particularly well suited for displaying the packages contents in a retail business, or may be placed directly on a store shelf. Placing the bottom formed by the disengaged bottom blank 12C directly on the store shelf will thereby increase shelf organization, and facilitate more effecting shelf stocking.

IV. Fourth Embodiment

FIGS. 16-20 illustrate an alternative fourth embodiment of the present invention, shown as container 10D, having an alternative side panel release structure as described in detail below.

Figure 17:
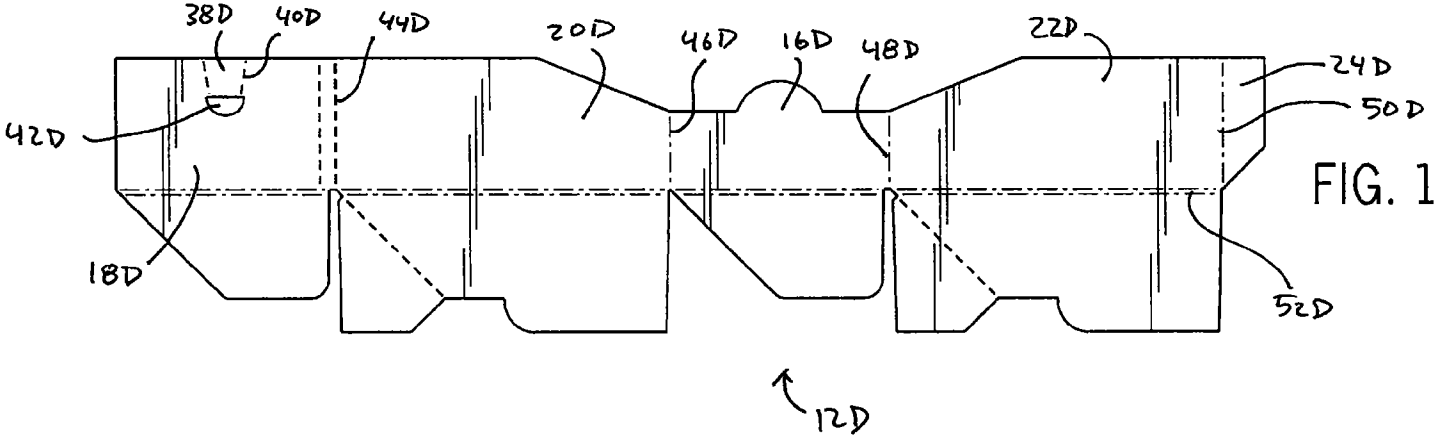
FIG. 17 is a top plan view of an unfolded bottom blank of a container, according to the third alternative embodiment of the present invention.

Referring initially to FIG. 17, the container 10D generally is made of a bottom sheet or blank 12D and a top sheet or blank 14D of packaging material. The packaging material may consist of corrugated board, fiberboard, cardboard, or any similar material suitable for use in shipping container construction. The bottom blank 12D and top blank 14D may be stamped or cut from the packaging material, while in a substantially flat orientation, and subsequently folded to form the container 10D. The outer surface of the container 10D may be printed to display information such as content details, shipping information, disassembly instructions, and the like. The outer surface of the container 10D may also contain advertising information, ornamental elements, or apertures that allow a portion of the contents to be viewed while in the container 10D.

FIG. 17 illustrates the bottom blank 12D, formed of a single piece of packaging material in a flat orientation. The bottom blank 12D includes primarily a front panel 16D, a rear panel 18D, and two side panels 20D, 22D. Side panel 22D also includes an extension tab 24D, designed to engage the inner surface of the rear panel 18D when in a folded configuration. As opposed to prior embodiments, no side tabs are located in or around the two side panels 20D, 22D in this embodiment. Accordingly, the side panels 20D, 22D may be uninterrupted surfaces, lacking openings or perforated lines. However, as seen in FIG. 17, the rear panel 18D may include a rear tab 38D, as discussed in the previous embodiments. The rear tab 38D may either protrude from the top surface of the rear panel 18D or may be integrated into the rear panel 18D as illustrated in this embodiment. A perforated line 40D may partition the rear tab 38D from rear panel 18D. Also, the rear tab 38D may include a finger opening 42D, designed to allow a user to insert a finger into the container 10D during the disengaging process similar to that of the second embodiment. Alternatively, the rear tab 38D may be disengaged by a process similar to that of the third embodiment, in which case the tear tab 38D is intended to be pushed inward to disengage, and does not require a finger opening 42D.

The panels 16D, 18D, 20D, and 22D of bottom blank 12D are formed of a single piece of packaging material and divided by vertical score lines 44D, 46D, 48C, and 50D as illustrated in FIG. 17. A bottom score line 52D extends along the bottom of the four panels to differentiate a lower area in each of the four panels. When affixed to the top blank 14D and placed in a folded orientation, the bottom blank 12D is folded along the vertical score lines 44D, 46D, 48D, and 50D until the extension tab 24D engages the inner surface of the rear panel 18C, thereby forming a cuboid open on the opposing top and bottom sides. To maintain the bottom blank 12D in the folded configuration, the extension tab 24C is secured to the inner surface of the rear panel 18D by means of glue, fasteners, adhesive tape or any other known means of fixation. When the lower areas of the four panels 16D, 18C, 20D, and 22D are further folded along the bottom score line 52D, a bottom surface 54D is formed. As seen in FIG. 17, the lower areas of the four panels 16D, 18D, 20C, 22D may be cut in a non linear form such that they interconnect with one another when in a folded configuration, thereby retaining the bottom surface 54D in a closed configuration which may or may not be maintained by glue, fasteners or adhesive tape. Alternatively, the lower areas of the four panels 16D, 18D, 20D, and 22D may be cut in a linear form, and overlap when in a folded configuration that is retained by glue, fasteners or adhesive tape.

Figure 16:
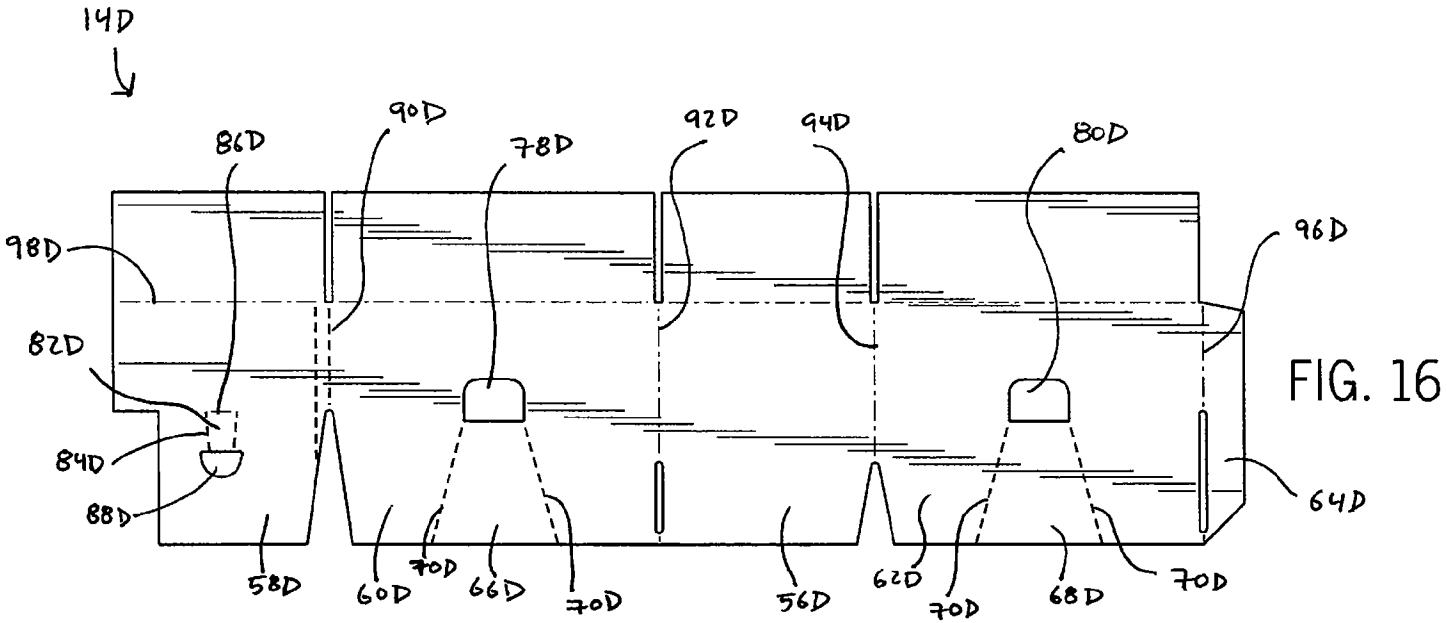
FIG. 16 is a top plan view of an unfolded top blank of a container, according to a third alternative embodiment of the present invention.
Figure 18:
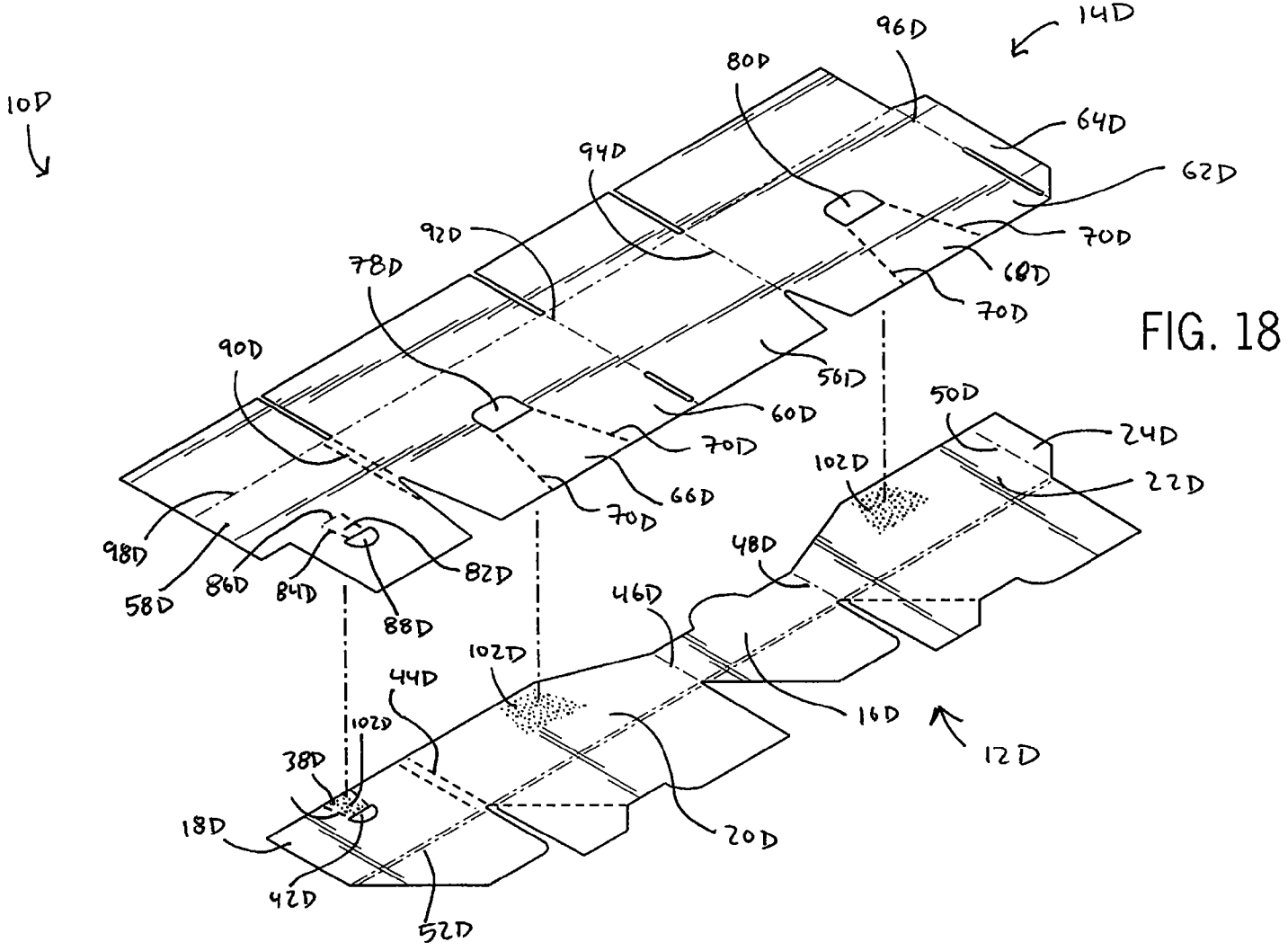
FIG. 18 is an exploded isometric view of the unfolded top blank of FIG. 16 and the unfolded bottom blank of FIG. 17 prior to the unfolded top and bottom blanks being secured together.

FIG. 16 illustrates the top blank 14D, formed of a single piece of packaging material in a flat orientation. The top blank 14D includes primarily a front panel 56D, a rear panel 58D, and two side panels 60D, 62D. Side panel 62D also includes an extension tab 64D, designed to engage both the inner surface of the top sheet rear panel 58D and the inner surface of the bottom sheet rear panel 18D, when in a folded configuration. Located within the side panels 60D, 62D are two side fixation areas 66D, 68D. The side fixation areas 66D, 68D are positioned to engage the inner surfaces of the side panels 20D, 22D when the bottom blank 12D is positioned over the top sheet 14D, as illustrated in FIG. 18. Perforated lines 70D, 72D may partition the side fixation areas 66D, 68D from the two side panels 60D, 62D respectively. In one embodiment, the perforated lines 70D, 72D may fully extend around the side fixation areas 66D, 68D, such that the side fixation areas 66D, 68D fully tear away from the two side panels 60D, 62D when force is applied, as will be discussed in further detail below. The perforated lines 70D, 72D which define the side fixation areas 66D, 68D are tapered, as seen in FIG. 16, as to allow for easier separation of the top and bottom sections of the container 10D, once disengaged. Furthermore, the side fixation areas 66D, 68D may include finger openings 78D, 80D located adjacent the side fixation areas 66D, 68D. The finger openings 78D, 80D may consist of a void, a slot, or a perforated area designed to rupture in response to an applied force. In this embodiment, the finger openings 78D, 80D may be large enough to facilitate a user placing one or more fingers through the finger openings 78D, 80D, and engage the inner side of the side fixation areas 66D, 68D and exert an outward force sufficient to tear the perforated lines 70D, 72D.

In addition, the top sheet rear panel 58D may also include a rear fixation area 82D located within the rear panel 58D. The rear fixation area 82D is similar in size to the rear tab 38D, and is positioned to engage the inner surface of the rear tab 38D when the bottom blank 12D is positioned over the top blank 14D, as illustrated in FIG. 18. A perforated line 84D may partition the rear fixation area 82D from the remainder of the rear panel 58D, and may include fewer perforations along an edge 86D of the rear fixation area 82D, such that the edge 86D will hinge rather than fully tear when force is applied. In one embodiment, the rear fixation area 82D does not include a finger opening 88D located adjacent the rear fixation area 82D, to allow the rear fixation area 82D to be disengaged by means of pushing inward as opposed to being pulled outward. Alternatively, the rear fixation area may be absent from the rear panel 58D when utilizing a rear tab release structure described above in connection with the third embodiment.

The panels 56D, 58D, 60D, 62D of top blank 14D are formed of a single piece of packaging material and divided by vertical lines 90D, 92D, 94D, and 96D as illustrated in FIG. 18. The vertical lines 90D, 92D, 94D, and 96D may consist of score lines, apertures, slots or any other style void or structural integrity reduction that facilitates folding of the packaging material. A top score line 98D extends along the top of the four panels to differentiate a top area in each of the four panels. When affixed to the bottom blank 12D and configured in an erected or folded orientation, the top blank 14D is folded along the vertical lines 90D, 92D, 94D, and 96D until the extension tab 64D engages both the inner surface of the top sheet rear panel 58D and the inner surface of the bottom sheet rear panel 18D, thereby forming a cuboid open on the opposing top and bottom sides. When the upper areas of the four panels of the top blank 14D are further folded along the top score line 98D, a top surface 100D is formed such that the top blank 14D forms a top section of the container 10D. To maintain the top blank 14D in the folded configuration, the extension tab 64D is secured to the inner surface of the top sheet rear panel 58D by means of glue, fasteners, adhesive tape or any other known means of fixation. As illustrated in FIG. 18, the rear panel 58D may contain extension tabs below the top score line 98D, designed to engage the extension tab 64D in a folded configuration. The top surface 100D may also be retained in its folded configuration by means of glue, fasteners, adhesive tape or any other known means of fixation. Alternatively, the upper areas of the four panels 56D, 58D, 60D, 62D may contain a series of interlocking extensions that retain the top surface 100D in a folded configuration.

Turning now to FIG. 18, the bottom blank 12D and the top blank 14D will be described in an attached configuration. As illustrated in FIG. 18, the bottom blank 12D is oriented over the top blank 14D, such that when in an erected or folded configuration the top section formed by the top blank 12D is nested within the bottom section formed by the bottom blank 12D. The blanks 12D, 14D are aligned such that the bottom blank side panels 20D, 22D are positioned directly above the top blank side fixation areas 66D, 68D. In such an orientation, the bottom sheet rear tab 38D is also positioned directly above the top sheet rear fixation area 82D, as illustrated in FIG. 18. As a result, the bottom sheet vertical score lines 44D, 46D, 48D, 50D overlap with the top sheet vertical lines 90D, 92D, 94D, 96D, respectively. To retain the relative location of the bottom blank 12D to the top blank 14D, an adhesive 102D is applied to the interface between the top sheet fixation areas 66D, 68D, 82D, the bottom sheet side panels 20D, 22D and the bottom sheet tab 38D respectively. However, alternative fixation means such as fasteners or adhesive tapes are considered within the scope of this invention.

Figure 20:
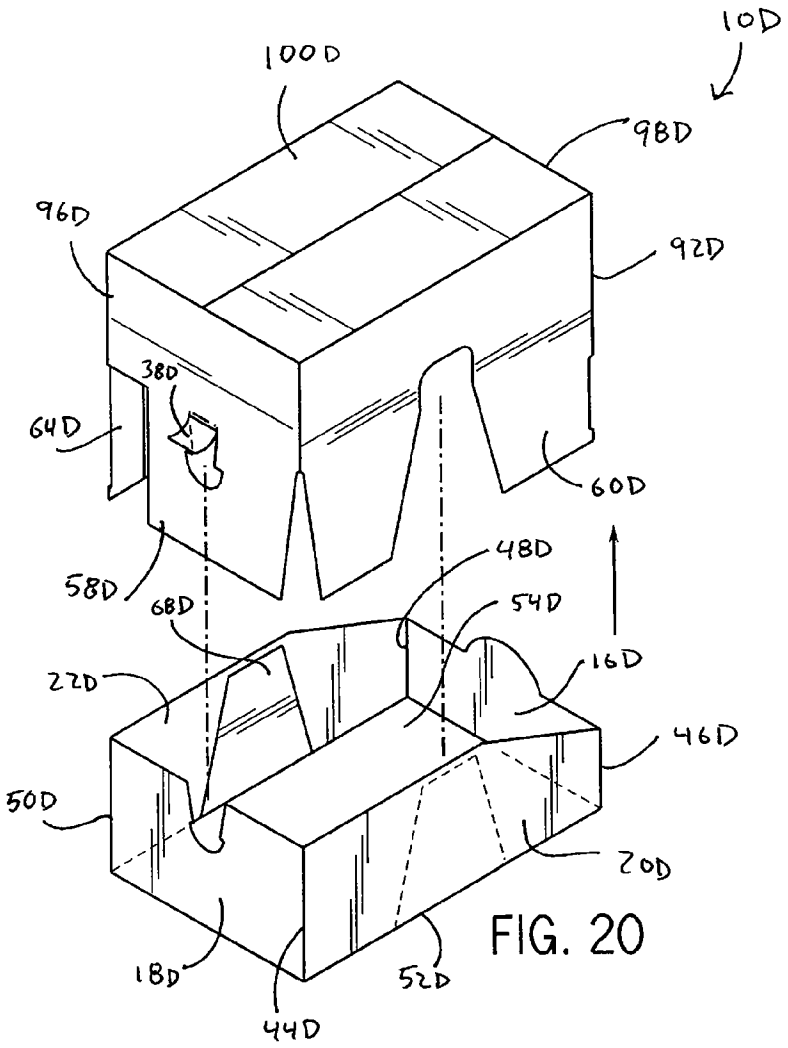
FIG. 20 is a perspective view of the container of FIG. 19, showing the top and bottom sections separated from each other to place the container in an open configuration.
Figure 19:
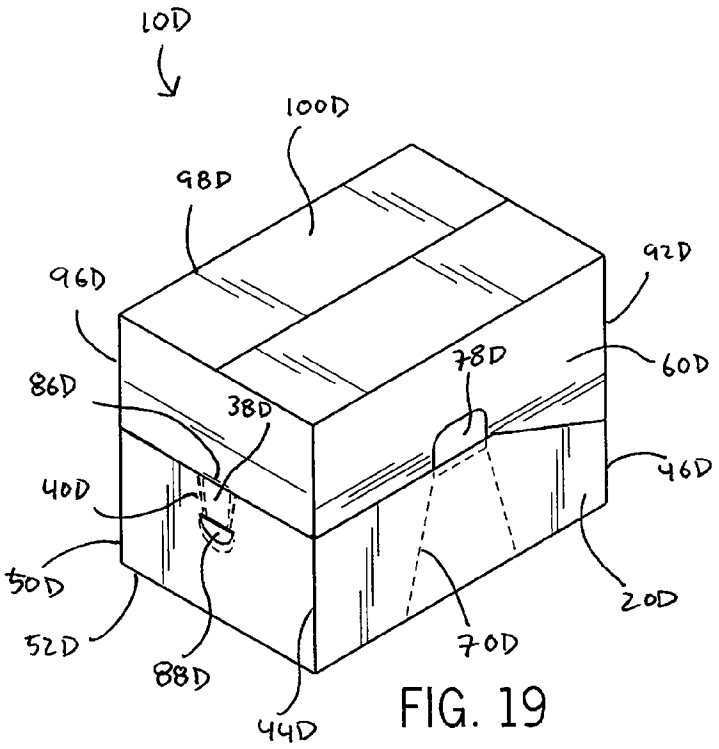
FIG. 19 is a perspective view of the container in accordance with the third alternative embodiment of the present invention, which is formed by erecting the secured-together top and bottom blanks as in FIG. 18 to form top and bottom sections, respectively, showing the top and bottom sections together to place the container in a folded and closed configuration.

Having been attached while in a flat configuration, as illustrated in FIG. 18, the bottom blank 12D and the top blank 14D may subsequently be placed in an erected or folded configuration to form container 10D, in order to receive contents therein, as illustrated in FIGS. 19 and 20. The affixed bottom blank 12D and top blank 14D of container 10D are simultaneously folded around the vertical score lines 44D, 46D, 48D, 50D and the vertical lines 90D, 92D, 94D, 96D, respectively until the extension tabs 24D, 64D engage both the inner surface of the top sheet rear panel 58D and the inner surface of the bottom sheet rear panel 18D. Having thereby formed a cuboid open on the opposing top and bottom sides, the extension tab 24D is secured to the inner surface of the bottom sheet rear panel 18D and the top sheet extension tab 64D is secured to the top sheet rear panel 58D, thereby maintaining the form of the container 10B. Subsequently folding the lower areas of the four panels of the bottom sheet 14D along the bottom score line 52D results in the formation of bottom surface 54D. The bottom surface 54D may either retain its shape by means of frictional engagement of the bottom sheet panels, or may require the addition of glue, fasteners, adhesive tape or any other known means of fixation. Once the bottom surface 54D of the container 10D is formed, the contents may be loaded into the container 10D via the open top. Representatively, the contents may be oriented such that they face the front panel 16D of the container 10D. After the contents have been loaded in the container 10D, the upper areas of the four panels of the top blank 12D are folded along the top score line 98D, to form top surface 100D. The top surface 100D may be retained in its folded configuration by means of glue, fasteners, adhesive tape or any other known means of fixation. As a result, the contents of the container 10D are fully enclosed within the container 10C, and as such are properly prepared for the shipping or distribution.

After the container 10D has been shipped to its destination, the user will be required to disassemble the container 10D to gain access to the contents contained therein, as illustrated in FIG. 20. To disassemble the container 10D a user will push a finger into, i.e. exert pressure onto rear tab 38D of the bottom blank rear panel 18D, as was described in the third embodiment. This force will simultaneously be transferred to the rear fixation area 82D of the rear panel 58D. When sufficient force has been exerted by the user, the perforated line 40D, which entirely surrounds the rear tab 38D will tear, as will the perforated line 84D, which surrounds three sides of the rear fixation area 82D. This tearing results in the rear tab 38D disengaging from the bottom blank 12D, while remaining adhesively attached to the top blank 14D rear fixation area 82D, and both the rear tab 38D and rear fixation are 82D hinging to the top blank 14D about the edge 86D. Alternatively, the rear tab 38D and rear fixation area 82D may be disengaged in accordance with the structure and method described above in connection with the first and second embodiments, namely by extending a finger into container 10D via the opening 42D, and pulling outward.

After the rear tab 38D has been disengaged, the user may disengage the side fixation areas 66D, 68D from the side panels 20D, 22D. To do so, the user will first insert a finger or multiple fingers into the finger openings 78D, 80D, and engage the inner side of the side fixation areas 66D, 68D by curling the finger or fingers. By then exerting outward pressure on the inner side of the side fixation areas 66D, 68D and retracting his or her curled finger, the user exerts a force on the side fixation areas 66D, 68D sufficient to tear the perforated line 70D, 72D of the top blank 14D. Since the adjacent side panels 20D, 22D of the bottom blank 12D do not have perforations or side tabs, the separated side fixation areas 66D, 68D of the top blank 14D remain adhesively attached to the inner side of the side fixation areas 66D, 68D and the side panels 20D, 22D perforated line 30D, 32D of the bottom blank 12D. This tearing results in side fixation areas 66D, 68D disengaging from the top blank 14D, while remaining attached to the bottom blank 12D. The user must repeat this process on both sides of the container 10D to fully disengage the top section formed by the top blank 14D from the bottom section formed by the bottom blank 12D, as illustrated in FIG. 20. It should be noted that the rear tab 38D and two side fixation areas 66D, 68D may be disengaged in any order, prior to lifting the top section formed by the top blank 14D off of the bottom section formed by the bottom blank 12D.

Once the rear tab 38D and both side tabs 26D, 28D have been disengaged, the top section of the container formed by the top blank 14D is disengaged from the bottom section of the container formed by the bottom blank 12D, and the user may remove the top section of the container 10D formed by the top blank 14D, as illustrated in FIG. 20. The user may grasp the top section formed by the top blank 14D in the finger openings 78D, 80D in the side panels 60D, 62D. By pulling vertically, as illustrated in FIG. 15, the top section formed by the top blank 14D lifts and separates from bottom section formed by the bottom blank 12D. As opposed to disassembling traditional shipping containers, this method involves only the tearing of perforated lines, and as such requires no specialized tools for cutting through adhesive tape, packaging material or banding. As the disassembly of container 10D requires no tools, it poses no risk to damaging the product contained therein and therefore eliminates the need for specialized training or supervision during package disassembly.

As a result, after the top section formed by the top blank 14D has been removed, the bottom section of the container formed by the bottom blank 12D remains resting, in a folded configuration with the contents of the container 10D contained therein. Accordingly, the section formed by the bottom blank 12D may be used as a tray to display the contents of the container 10D. As illustrated in FIGS. 12 and 15, the front panel 16D of the bottom blank 12D may have a reduced height relative to the other panels 18D, 20D, and 22D; thereby allowing both display of and easy consumer access to the contents of the container 10D. Therefore, the disengaged bottom section formed by the bottom blank 12D is particularly well suited for displaying the packages contents in a retail business, or may be placed directly on a store shelf. Placing the bottom section formed by the disengaged bottom blank 12D directly on the store shelf will thereby increase shelf organization, and facilitate more effecting shelf stocking.

As illustrated in the various embodiments discussed above, the size and shape of the container 10 may vary greatly to accommodate the size and shape of the contents. While the figures have illustrated hand-held size containers, larger containers are considered well within the scope of this invention. In this regard, containers for large size items such as home appliances, furniture, or televisions are within the scope of this invention. Similarly, any number, location, variation or combination in the multiple styles of tab and fixation area disengagement embodiments described herein is considered within the scope of the present invention.

It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features, i.e. tabs and fixation areas, mentioned or evident from the text and/or drawings. All of these different combinations constitute various alternative aspects of the present invention. The embodiments described herein explain the best modes known for practicing the invention and will enable others skilled in the art to utilize the invention.

I claim:

1. A container, comprising:

a first blank configured to form a first section of the container, the first blank having at least one first blank primary fixation area defined between a first perforated line and a second perforated line extending from an aperture within a panel of the first blank to an edge of the first blank, and a second blank configured to form a second section of the container, the second blank having at least one second blank primary fixation area, wherein in a first configuration in which the first and second sections of the container are secured together, the first section is nested with the second section to form the container, and the at least one first blank primary fixation area is affixed to the at least one second blank primary fixation area; and wherein in a second configuration in which the first and second sections of the container are separated, the at least one first blank primary fixation area is separated from the first blank along the first and second perforated lines, and the separated at least one first blank primary fixation area remains affixed to the at least one second blank primary fixation area of the second blank as to allow the first section of the container to be separated from the second section of the container.

2. The container of claim 1 wherein the first blank primary fixation area is located on a side panel of the first blank and the second blank primary fixation area is located on a side panel of the second blank, and further comprising, a first blank secondary fixation area in a rear panel of the first blank;

a second blank secondary fixation area in a rear panel of the second blank;

wherein in the first configuration, the first blank secondary fixation area is affixed to the second blank secondary fixation area;

wherein in the second configuration, the second blank secondary fixation area is separated from the rear panel of the second blank, and the first blank secondary fixation area is disengaged from the rear panel of the first blank as to rotate about a hinge while retaining the affixed second blank secondary fixation area; and wherein the second blank secondary fixation area rotated about the hinge comprises a handle for separating the first section of the container from the second section of the container.

3. The container of claim 1 wherein, in the second configuration, the aperture within the side panel of the first blank comprises a handle for separating the first section of the container from the second section of the container.

4. The container of claim 1, wherein the at least one first blank primary fixation area is affixed to the at least one second blank primary fixation with an adhesive.

5. The container of claim 2, wherein in the first configuration, the hinge in the rear wall of the first blank is disposed adjacent an upper edge of the rear wall of the second blank.

6. The container of claim 2, wherein the first blank secondary fixation area rotated about the hinge comprises a handle for separating the first section of the container from the second section of the container.

7. The container of claim 1, wherein the aperture within the panel of the first blank is configured to receive an at least one finger of a user therein.

8. The container of claim 1, wherein the second section is configured to display contents contained within the container.

9. The container of claim 1, wherein the at least one first blank primary fixation area comprises a first and a second first blank primary fixation area; and the at least one second blank primary fixation area comprises a first and a second blank primary fixation area; wherein the first and second first blank primary fixation areas are affixed to the first and second secondary blank primary fixation areas respectively, on different sides of the container.

10. The container of claim 1, wherein the at least one first blank primary fixation area is substantially trapezoidal.

11. The container of claim 2, further comprising:

an access opening in the rear wall of the second blank adjacent the second blank secondary fixation area, the access opening configured to receive at least one finger of a user therein.

12. The container of claim 11, further comprising an access opening in the rear wall of the first blank adjacent the first blank secondary fixation area, the access opening configured to receive at least one finger of a user therein.

* * * * *